US007123862B2

(12) United States Patent
Hasegawa et al.

(10) Patent No.: US 7,123,862 B2
(45) Date of Patent: Oct. 17, 2006

(54) IMAGE FORMING APPARATUS

(75) Inventors: Yusuke Hasegawa, Shizuoka (JP); Yuichi Mizoo, Ibaraki (JP); Tadashi Dojo, Shizuoka (JP); Nene Shibayama, Shizuoka (JP); Tomohisa Sano, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 358 days.

(21) Appl. No.: 10/832,445

(22) Filed: Apr. 27, 2004

(65) Prior Publication Data

US 2004/0223786 A1 Nov. 11, 2004

(30) Foreign Application Priority Data

May 2, 2003 (JP) ..... 2003-126895
Feb. 6, 2004 (JP) ..... 2004-030826

(51) Int. Cl.
*G03G 15/01* (2006.01)
*G03G 9/00* (2006.01)

(52) U.S. Cl. ..... 399/223; 399/252; 430/122; 430/120; 430/106.2; 430/110.4; 430/45

(58) Field of Classification Search ..... 399/223, 399/252; 430/122, 120, 106.2, 110.4, 45
See application file for complete search history.

(56) References Cited

U.S. PATENT DOCUMENTS

| | | | | |
|---|---|---|---|---|
| 5,612,159 | A | 3/1997 | Sato et al. | 430/110 |
| 6,586,151 | B1 | 7/2003 | Naka et al. | 430/137.2 |
| 6,703,176 | B1 | 3/2004 | Naka et al. | 430/110.3 |
| 2003/0122911 | A1 | 7/2003 | Mizoo et al. | 347/95 |

FOREIGN PATENT DOCUMENTS

| | | |
|---|---|---|
| EP | 0 592 018 A2 | 4/1994 |
| EP | 0 729 075 A2 | 8/1996 |
| EP | 0 822 457 A1 | 2/1998 |
| JP | 56-29248 | 3/1981 |
| JP | 58-066951 | 4/1983 |
| JP | 59-168458 | 9/1984 |
| JP | 59-168459 | 9/1984 |
| JP | 59-168460 | 9/1984 |
| JP | 59-170847 | 9/1984 |
| JP | 1-204068 | 8/1989 |
| JP | 8-82949 | 3/1996 |
| JP | 00-10334 | 1/2000 |
| JP | 001-249488 | 9/2001 |
| JP | 002-49172 | 2/2002 |
| JP | 002-91053 | 3/2002 |
| JP | 002-162772 | 6/2002 |

*Primary Examiner*—Mark A. Chapman
(74) *Attorney, Agent, or Firm*—Fitzpatrick, Cella, Harper & Scinto

(57) ABSTRACT

In an image forming apparatus having at least an amorphous silicon photosensitive member, a magnetic toner developing means and a color developer developing means, the magnetic toner has a weight-average particle diameter (D4) of from 4.0 μm to 10.0 μm and a ratio thereof to number-average particle diameter (D1), D4/D1, of from 1.0 to 2.0, and the number of magnetic particles not passing through a mesh with an opening of 34 μm which are contained in the unit volume of the magnetic toner is from 3.5 to 105. This image forming apparatus can not easily cause faulty cleaning performance even in using the magnetic toner and the non-magnetic color toners in combination and has superior environmental stability and running stability even where toners made to have small particle diameter are used or process speed is high.

8 Claims, 3 Drawing Sheets

IMAGE FORMING APPARATUS

BACKGROUND OF THE INVENTION

1. Field of the Invention

This invention relates to an image forming apparatus making use of an amorphous silicon photosensitive member.

2. Related Background Art

In recent years, in full-color copying machines or full-color printers, it is required to enrich their functions as black-and-white machines. That is, even in full-color copying machines or full-color printers, the same speed and high image quality as those in black-and-white machines are required in monochromatic image formation, and in addition thereto there is an increasing need for copying machines or printers that can form full-color images with sharpness and high image quality. In such copying machines or printers, they are frequently used for black color alone, and toners therefor are also necessarily used in a large quantity. Accordingly, black toners in future full-color copying machines or printers are required to have higher image reproduction performance and running stability.

In electrophotography, many developing methods are known in the art. In particular, developing methods making use of magnetic developers are superior in view of running stability and running cost.

Meanwhile, in high-speed machines required to have running stability and high reliability, amorphous silicon photosensitive members are preferably used. The amorphous silicon photosensitive members have advantages that they have high sensitivity over the whole region of visible light and have so high surface hardness as to have superior durability, heat resistance and environmental stability.

Usually, toner particles having participated in development on a photosensitive member in an electrophotographic process are transferred to a transfer material such as paper, where residual toner particles not transferred thereto and having remained on the photosensitive member are removed by a cleaning member. It, however, is difficult to remove the residual toner particles completely therefrom, and residual toner particles having not been removed remain on the photosensitive member surface to become adhere or cling to the surface of the photosensitive member unwantedly. The toner particles remaining on the surface of the photosensitive member and the toner particles having adhered or clung to the surface of the photosensitive member usually do not come into question because they are usually scraped off together with the surface of the photosensitive member by the friction with toner particles or other members in the subsequent developing step or transfer step.

However, the amorphous silicon photosensitive members have so high hardness that their surfaces can not easily be scraped, and it is difficult to remove the toner particles having adhered or clung to the surface of the photosensitive member.

In addition, digital copying machines chiefly employ a method in which electrostatic latent images are formed by means of a laser. Hence, in order to achieve a high-resolution and high-minuteness developing system, it has been put forward to make toner particles have small particle diameter. However, such toner particles made to have small particle diameter are not well removable by cleaning, and hence it is attempted to improve cleaning performance by, e.g., making contact pressure of a cleaning blade higher against the photosensitive member. However, where magnetic toner particles are used, the magnetic material having come bare to toner particle surfaces may scratch the surface of the photosensitive member to cause deterioration of image quality.

Toner particles are also usually present at the part where the cleaning blade and the photosensitive member come into contact with each other. Such toner particles present there a little have the function of lubrication between the cleaning blade and the photosensitive member to make always good cleaning performable. However, it is known that, if such toner particles reduce abruptly, the lubricity may become locally poor, so that the cleaning blade may turn up in the rotational direction of the photosensitive member or may vibrate on the photosensitive member to come into a state that it can not remove the residual toner particles on the photosensitive member. Such a problem is more remarkable as higher speed is achieved (process speed is higher).

In order to keep such a phenomenon from occurring, it is practiced that, for the purpose of stable feed of toner particles to the cleaning blade, a magnet roller is placed on the upstream side of the cleaning blade in the rotational direction of the photosensitive member to apply toner particles on the photosensitive member at the same time the residue matter on the photosensitive member is scraped off by rubbing. By such a means, toner particles collected by cleaning do form a magnetic brush, which feeds the toner particles again to the surface of the photosensitive member. This has brought certain effect in respect of cleaning performance of systems making use of magnetic developers.

Aiming at further improvement of these, it is proposed to incorporate an inorganic fine powder as an abrasive or a lubricant in a magnetic developer. For example, it is disclosed that conductive zinc oxide and tin oxide are incorporated (e.g., Japanese Patent Applications Laid-open No. S58-66951, No. S59-168458, No. S59-168459, No. S59-168460 and No. S59-170847) or that cerium fluoride or fluorine-containing cerium oxide particles are incorporated (e.g., Japanese Patent Applications Laid-open No. H1-204068 and No. H8-82949). In these methods, however, any stable image density is not obtainable when digital high-speed development is performed, or abrasive particles may non-uniformly scrape the photosensitive member because their hardness is not uniform. This has tended to make the blade turn up and to cause slip-through of toner particles, because of a difference in coefficient of friction between the photosensitive member and the cleaning blade at the abraded part and the unabraded part.

Non-magnetic toners as commonly used as color toners. In the case when as stated above the magnetic developer is used as a black developer of a full-color copying machine, it is difficult to well remove both the non-magnetic toner and the magnetic-developer by cleaning, because of a difference in proper cleaning conditions between the both. It is also prevalent to use a magnetic-brush cleaning member as a cleaning auxiliary member, which, however, tends to lower the cleaning performance on the surface of the photosensitive member when full-color copying is relatively frequently used. This phenomenon may be remarkable especially when polymerization toners are used as non-magnetic color toners for the purpose of improving transfer efficiency and so forth. Toners produced by polymerization commonly have a high circularity, and hence the toners may frequently slip through the cleaning blade and this may further make poor the lubricity between the blade and the photosensitive member, so that a local force may be applied to the blade to cause its edge to chip.

Meanwhile, it is attempted to reproduce fine lines sharply even without making average particle diameter small so much, using a magnetic toner to which coarse particles are added to make the toner contain 16 μm or larger particles in a proportion of 2.1 to 4.0% by volume to broaden particle size distribution (Japanese Patent Application Laid-open No. 2001-249488). Also, as a technique concerning the mixture of a plurality of magnetic toners, there is a disclosure of a magnetic toner having two peaks in particle size distribution, in the region of 50 μm or less (Japanese Patent Application Laid-open No. S56-29248). In these magnetic toners, the toners have a relatively good charging performance at the beginning of use, but may come to have an unstable charging performance with progress of running over a long period of time while repeating replenishment. Especially in severe environment such as a high-temperature and high-humidity environment, image density may decrease, or the toner tends to participate in development at non-image areas to cause fog.

It is also attempted to improve transfer performance and so forth by incorporating coarse particles in an appropriate quantity (e.g., Japanese Patent Applications Laid-open No. 2002-91053, No. 2000-10334, No. 2002-49172 and No. 2002-162772). If, however, it is attempted to use such a toner in magnetic toners, the charging stability, running stability and so forth just owing to the magnetic toners may be damaged because the size of the coarse particles is unsuitable or because their quantity is too large.

In addition, in the above techniques, coarse particles which are so large as to be more than 100 μm are contained in a relatively large quantity in many cases. The presence of such coarse particles at the cleaning blade tends to make white lines appear on images or cause the blade edge to chip to cause image defects. Furthermore, there has been a problem such that, when used in, e.g., a full-color copying machine making use of a magnetic black toner and non-magnetic color toners in combination, faulty cleaning may occur for the reasons stated above.

Thus, in magnetic developers used in the one-component developing system, any magnetic developer has not been materialized that has running stability and charging stability well fittable to high-speed digital machines and at the same time can exhibit superior cleaning performance even when used in combination with non-magnetic color toners.

SUMMARY OF THE INVENTION

Accordingly, the present invention has been made at an aim to overcome the above problems, taking account of the above circumstances in the related background art.

More specifically, an object of the present invention is to provide an image forming apparatus which exhibits superior cleaning performance in image formation making use of a magnetic toner and non-magnetic color toners.

Another object of the present invention is to provide an image forming apparatus that can achieve both superior cleaning performance and superior charging stability and running stability even where the toner particles have been made to have small particle diameter or even where process speed has been made higher.

That is, the present invention provides an image forming apparatus having at least:

an amorphous silicon photosensitive member;

two or more developing means provided in respect to the amorphous silicon photosensitive member; one of the developing means being a magnetic-toner developing means having a magnetic toner, and the remaining developing means being a color developer developing means having a developer containing a non-magnetic color toner; and a cleaning means provided in contact with the surface of the amorphous silicon photosensitive member to clean the surface of the photosensitive member;

the magnetic toner having a weight-average particle diameter (D4) of from 4.0 μm to 10.0 μm and a ratio thereof to number-average particle diameter (D1), D4/D1, of from 1.0 to 2.0; and where the true density of the magnetic toner is represented by d (g/cm$^3$) and the number of magnetic particles not passing through a mesh with an opening of 34 μm which are contained in m (g) of the magnetic toner is represented by n, the number N (=n/(m/d)) of magnetic particles not passing through a mesh with an opening of 34 μm which are contained in the unit volume of the magnetic toner satisfying the following expression:

$$3.5<N<105.$$

DESCRIPTION OF THE PREFERRED EMBODIMENTS

The amorphous silicon photosensitive member in the present invention is a photosensitive member which may preferably have an average gradient Δa in the range of from 0.12 to 1.0, and more preferably in the range of from 0.15 to 0.8.

The Δa may be measured with an atomic force microscope (AFM) (Q-Scope 250, Version 3.181, manufactured by Quesant Instruments Corp.). Stated specifically, to measure microscopic surface roughness (profile) in a high precision and a good reproducibility, the curvature a sample AFM image has is made fit to a parabola according to the Tilt Removal mode of Q-Scope 250, manufactured by Quesant Instruments Corp., and thereafter correction (parabolic) is made to flatten it and further, when a gradient remains in the image, correction (line by line) is made to remove the gradient to make measurement. In this way, the gradient of the sample can appropriately be corrected within the range where no strain is produced in the data.

The average gradient Δa is described below in greater detail.

Average gradient Δa in a surface profile analyzer is defined by the following expression, which is described in instructions of a surface profile measuring instrument SE-3300, manufactured by Kosaka Laboratory, Ltd. in March 1993, Chapter 8 "Terms of Surface Roughness and Definitions of Parameters", Items 8–12. Incidentally, the average gradient Δa in this surface profile analyzer is the value calculated from a two-dimensional shape.

$$\Delta a = (1/L)\int_{O}^{L} |df/dx \cdot f(x)|\, dx$$

Meanwhile, average gradient Δa measured with the atomic force microscope (AFM) (Q-Scope 250, Version 3.181, manufactured by Quesant Instruments Corp.) refers to the value calculated from a three-dimensional shape in the range of 10 μm×10 μm.

The present inventors have found two-dimensional average gradient Δa of an arbitrary sectional curve from the three-dimensional shape measured with the atomic force microscope (AFM). As a result, the value found has substantially agreed with the average gradient Δa in the range of 10 μm×10 μm, found from the three-dimensional shape. However, from the viewpoint of the stability of measured values, it is more preferable to used the Δa found from the three-dimensional shape.

Note, however, that the average gradient Δa in the present invention is by no means limited to the Δa in the range of 10 μm×10 μm, found from the three-dimensional shape.

Figure 2:
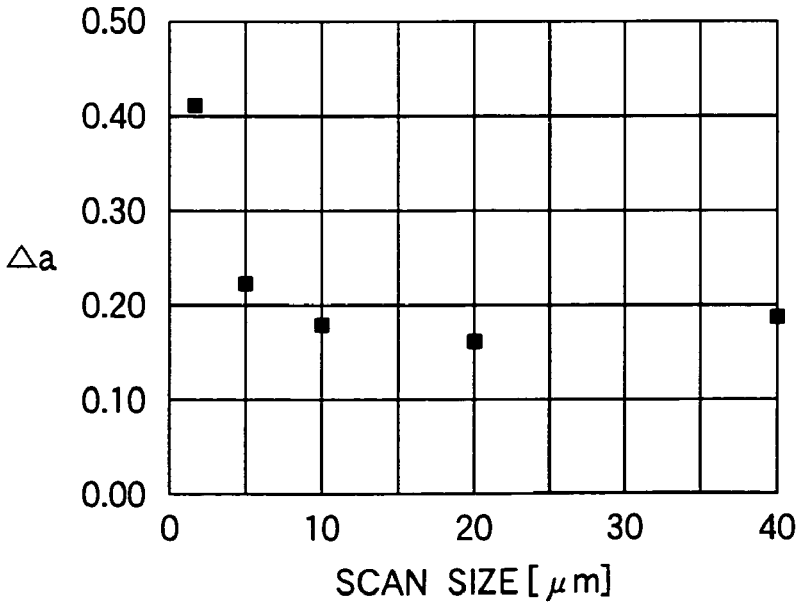
FIG. 2 is a plot which describes the range of measurement with an AFM in the present invention.

Incidentally, in measuring with the AMF, the present inventors have made measurement on several samples in several scan sizes. The scan size refers to the length of one side of a square to be scanned, and therefore a scan size of 10 μm means that the square is scanned in the range of 10 μm×10 μm, i.e., 100 $\mu m^2$. A part of results obtained by examining the relation with the average gradient Δa, setting the abscissa of a graph as the scan size, is shown in FIG. 2.

The measured values can be stable when the scan size is made large, i.e., the range of measurement is broadened. However, fine shapes can not easily be reflected under the influence of singular shapes such as undulation and projections of a sample substrate, and shapes of working. If the scan size is small, the scattering of choice of measurement spots comes large. Accordingly, in the present invention, the value is represented in the 10 μm×10 μm visual field that promises overall superiority in the detection ability and stability of measurement.

Note, however, that the average gradient Δa in the present invention is by no means limited to the one represented in the 10 μm×10 μm visual field.

According to studies made by the present inventors, it has been found that the use of the amorphous silicon photosensitive member whose average gradient Δa in the range of 10 μm×10 μm is in the range of from 0.12 to 1.0, and preferably in the range of from 0.15 to 0.8, enables further improvement in cleaning performance while affording performance well fittable to high-speed digital machines. The reason therefor is unclear, and it is presumed that good results are brought on cleaning characteristics and resistance to toner adhesion of the magnetic toner because the surface profile of the amorphous silicon photosensitive member is kept in the specific range.

According to studies made by the present inventors, it is also important for the magnetic toner to have a weight-average particle diameter (D4) of from 4.0 μm to 10.0 μm and a ratio thereof to a number-average particle diameter (1), D4/D1, of from 1.0 to 2.0, and preferably from 1.2 to 2.0.

A case in which the magnetic toner has a weight-average particle diameter of more than 10.0 μm is undesirable from the viewpoint of achievement of high image quality, because of the size of particles themselves. A case in which the magnetic toner has a weight-average particle diameter of less than 4.0 μm is undesirable because the state of dispersion of magnetic material iron oxide particles may come poor to cause difficulties such as fog and spots around line images. Also, in such a case, the magnetic toner has so large specific surface area as to have great agglomerative properties or adhesive properties, and hence the adhesive force acting between the photosensitive member and the toner particles may come strong to also make cleaning performance poor.

The value of D4/D1 also represents the sharpness of particle size distribution of the toner. It indicates that, the closer to 1 the value is, the sharper the particle size distribution is, and, the larger the value is, the broader the particle size distribution is. If this value of D4/D1 is more than 2.0, the charge quantity distribution of the toner is so broad as to tend to cause fog. Also, toner having smaller particle diameter and larger charge quantity may first participate in development, and hence a phenomenon tends to occur which is called selective development in which the proportion of presence of toner having large particle diameter increases with progress of running. Once the selective development takes place, the toner may have non-uniform charging performance to cause fog, or to tend to cause a decrease in image density. If on the other hand the value is less than 1.2, there may be a case undesirable in view of production because of a lowering of yield in a toner production process.

The particle size distribution may be measured by various, means. In the present invention, it is measured with a Coulter counter Multisizer.

A Coulter counter Multisizer Model II (manufactured by Beckman Coulter, Inc.) is used as a measuring instrument. An interface (manufactured by Nikkaki-Bios) that outputs number distribution and volume distribution and a personal computer CX-1 (manufactured by CANON INC.) are connected. As an electrolytic solution, an aqueous 1% NaCl solution is prepared using super-high grade or first-grade sodium chloride. Measurement is made by adding as a dispersant from 0.1 to 5 ml of a surface-active agent (preferably alkylbenzenesulfonate) to from 100 to 150 ml of the above aqueous electrolytic solution, and further adding from 2 to 20 mg of a sample to be measured. The electrolytic solution in which the sample has been suspended is subjected to dispersion for about 1 minute to about 3 minutes in an ultrasonic dispersion machine. Measurement is made with the above Coulter counter Multisizer Model II, using as an aperture an aperture of 100 μm when toner's particle diameter is measured and an aperture of 13 μm when inorganic fine powder's particle diameter is measured. The volume and number of the toner and inorganic fine powder are measured and the volume distribution and number distribution are calculated. Then, the weight-average particle diameter (D4) determined from the volume distribution and the number-average particle diameter (D1) determined from the number distribution are determined.

In the magnetic toner according to the present invention, where the true density of the magnetic toner is represented by d ($g/cm^3$) and the number of magnetic particles not passing through a mesh with an opening of 34 μm which are contained in m (g) of the magnetic toner is represented by n, the number N (=n/(m/d)) of magnetic particles not passing through a mesh with an opening of 34 μm which are contained in the unit volume of the magnetic toner satisfies the following expression:

$$3.5<N<105.$$

and may preferably satisfy the following expression:

$$10.5<N<71.0.$$

Here, the true density d of the magnetic toner is found using data measured with a dry densitometer ACCUPYC 1330, manufactured by Shimadzu Corporation.

During usual copying operation, the coarse magnetic particles participate in development together with the magnetic toner that contributes to image formation. As a result of extensive studies, the present inventors have discovered that the particle size distribution as the whole toner and the content of coarse magnetic particles may be controlled properly, whereby the coarse magnetic particles are periodically fed to the part where the cleaning blade and the photosensitive member come into contact with each other, without being selectively transferred. At the same time, they have discovered that the presence of such coarse magnetic particles at the part where the cleaning blade and the photosensitive member come into contact with each other enables good cleaning even when the process speed is made higher. Thus, they have accomplished the present invention.

For the purpose of stable feed of coarse magnetic particles to the cleaning blade, the present inventors have further placed, as stated previously, a magnet roller on the upstream side of the cleaning blade in the rotational direction of the photosensitive member to apply toner particles on the photosensitive member at the same time the residue matter on the photosensitive member is scraped off by rubbing. They have discovered that, especially in this case, the magnetic particles can stably be fed again to the surface of the photosensitive member in virtue of a magnetic brush formed by the coarse magnetic particles, and this dramatically improves cleaning performance of systems making use of magnetic developers.

As the result, as described above, good cleaning performance can be maintained even when, in a full-color copying machine, a magnetic toner is used as a black toner and non-magnetic toners are used as other color toners and full-color copying is relatively frequently used.

Good cleaning performance can also be maintained even when full-color copying is relatively frequently used in a full-color copying machine making use of high-circularity polymerization toners as non-magnetic color toners. Further, even once faulty cleaning has occurred, it is possible to restore cleaning performance by, e.g., appropriately controlling development conditions and transfer conditions at the time of no image formation, and making the magnetic particles preferentially participate in development on the photosensitive member and also fed to the part of the cleaning blade.

Here, if the number of magnetic particles not passing through a mesh with an opening of 34 μm which are contained in the unit volume of the magnetic toner is less than 3, faulty cleaning tends to occur when the non-magnetic color toners are frequently used. If on the other hand the number of magnetic particles not passing through a mesh with an opening of 34 μm which are contained in the unit volume of the magnetic toner is more than 100, during running, the coarse magnetic particles may accumulate in excess on the sleeve holding the toner, to conversely make the toner have unstable charging performance to cause image deterioration such as fog and a decrease in image density.

Incidentally, the magnetic particles not passing through a mesh with an opening of 34 μm which are contained in the unit volume of the magnetic toner may have the same composition as, or different composition from, magnetic particles passing through a mesh with an opening of 34 μm. From the viewpoint of having similar properties, it is preferable for the both have the same composition.

Figure 1:
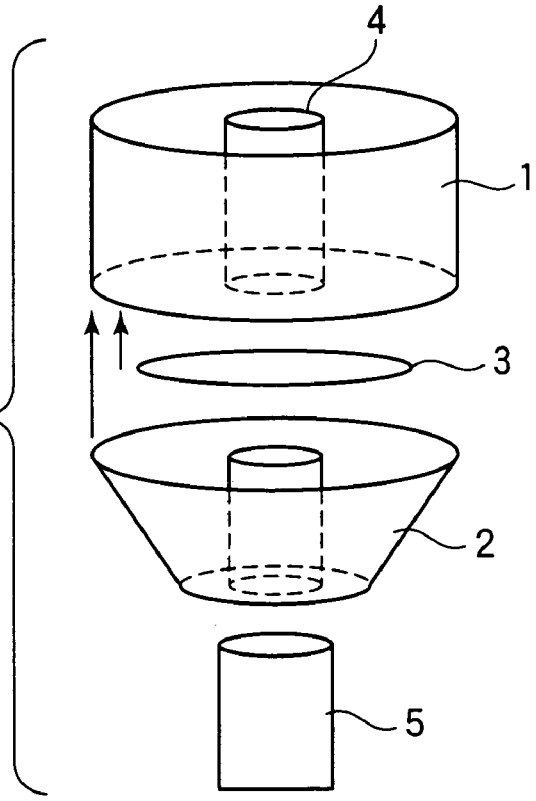
FIG. 1 is an illustration of a jig for counting magnetic particles.

Here, the magnetic particles can be counted with ease, using a measuring device as shown in FIG. 1. A mesh 3 with the stated opening is inserted between a jig upper portion 1 and a jig lower portion 2 and fastened thereat. As the mesh with an opening of 34 μm, a mesh may be used which is commercially available as a 400 mesh. With suction from the lower part of the jig lower portion 2 by means of, e.g., a suction hose 5, 5 g of a sample is gently introduced through a suction opening 4. Suction pressure may preferably be set to about 7 kPa so that a sample having a particle diameter smaller than the opening of the mesh 3 may sufficiently be sucked. After the sample has completely be sucked, the jig upper portion 1 is gently taken off, and magnetic particles present on the mesh are sampled by taping. The sample taken by taping is stuck onto paper, and is magnified about 30 times with a magnifier or a microscope to count the particles. Also, where a mesh with an opening of 100 μm is used, 100 g of the sample is used to carry out suction.

In the present invention, where the true density of the magnetic toner is represented by d ($g/cm^3$) and the number of magnetic particles not passing through a mesh with an opening of 100 μm which are contained in m (g) of the magnetic toner is represented by f, the number F (=f/(m/d)) of particles not passing through a mesh with an opening of 100 μm which are contained in the unit volume of the magnetic toner may preferably satisfy the following expression:

$$F<0.36;$$

and such particles may more preferably be substantially not contained (F=0).

If the number F of the magnetic particles not passing through a mesh with an opening of 100 μm satisfies the following expression:

$$F\geqq 0.36;$$

such magnetic particles may be the cause of fog especially in an environment of high humidity, or may be caught between a developing sleeve and a blade which controls a toner layer formed on the developing sleeve, to make defects such as white lines appear on images. To make measurement, in the above method the mesh may be changed for the one with an opening of 100 μm, and 100 g of the toner may be introduced.

As a result of studies further forwarded, the present inventors have also discovered that the effect of the present invention can better be brought out when the magnetic particles not passing through a mesh with an opening of 34 μm is made to have an average circularity smaller than the average circularity of the magnetic particles passing through a mesh with an opening of 34 μm. They have not made clear the reason therefor, and presume that making the coarse magnetic particles have a smaller average circularity makes the coarse magnetic particles not easily slip through the part between the cleaning blade and the photosensitive member to enhance the performance as a cleaning auxiliary and the effect of photosensitive member surface abrasion the magnetic particles themselves have.

The average circularity referred to in the present invention is used as a simple method for expressing the shape of particles quantitatively. In the present invention, measurement is made with a flow type particle image analyzer FPIA-2100, manufactured by Sysmex Corporation.

The circularity of particles is determined from the following equation:

$$\text{Circularity } a=L_0/L$$

wherein $L_0$ represents the circumferential length of a circle having the same projected area as a particle image, and L represents the circumferential length of a particle image formed when image-processed at an image-processing resolution of 512×512 (pixels of 0.3 μm×0.3 μm each); and the value obtained when the sum total of circularities of all particles measured is divided by the number of all particles as shown in the following equation is defined to be the average circularity ($a_{av}$).

$$\text{Average circularity } a_{av} = \sum_{i=1}^{m} (a_i/m)$$

The circularity standard deviation SD is also determined from the following equation.

$$\text{Circularity standard deviation } SD = \left\{ \sum_{i=1}^{m} (a_{av} - a_i)^2/m \right\}^{1/2}$$

In the above equations, ai represents the circularity in each particle, and m, the number of particles measured.

The circularity referred to in the present invention is an index showing the degree of surface unevenness of particles. It is indicated as 1.000 when the particles are perfectly spherical. The more complicate the surface shape is, the smaller the value of circularity is. Also, the circularity standard deviation SD is an index showing the scattering. It indicates that, the smaller the numerical value is, the smaller the scattering of toner particle shapes is.

The measuring instrument "FPIA-2100" used in the present invention employs a calculation method in which, in calculating the circularity of each particle and thereafter calculating the average circularity and circularity standard deviation, circularities of 0.4 to 1.0 are divided into 61 division ranges according to the circularities obtained, and the average circularity and circularity standard deviation are calculated using the center values and frequencies of divided points. Between the values of the average circularity and circularity standard deviation calculated by this calculation method and the values of the average circularity and circularity standard deviation calculated by the above calculation equation which uses the circularity of each particle directly, there is only a very small error, which is at a level that is substantially negligible. Accordingly, in the present invention, such a calculation method in which the concept of the calculation equation which uses the circularity of each particle directly is utilized and is partly modified may be used, for the reasons of handling data, e.g., making the calculation time short and making the operational equation for calculation simple.

In addition, compared with "FPIA-1000" used conventionally to calculate particle shapes of toners, the measuring instrument "FPIA-2100" used in the present invention is an instrument having been improved in precision of measurement of particle shapes of toners because of a sheath flow made thin-layer (from 7 μm to 4 μm) and an improvement in magnification of processed particle images and also an improvement in processing resolution of images captured (from 256×256 to 512×512), and therefore having achieved surer capture of fine particles. Accordingly, where the particle shapes must more accurately be measured as in the present invention, FPIA-2100 is more useful, with which the information concerned with particle shapes can more accurately be obtained.

The circularity standard deviation SD may be used as a standard of scattering of particles having such circularities. In the present invention, it is preferable for the circularity standard deviation SD to be from 0.030 to 0.065.

As a specific method for the measurement, 0.1 to 0.5 ml of a surface-active agent, preferably an alkylbenzene sulfonate, as a dispersant is added to 100 to 150 ml of water from which any impurities have previously been removed. To this solution, about 0.1 to 0.5 g of a measuring sample is further added. The resultant suspension in which the sample has been dispersed is irradiated with ultrasonic waves (50 kHz, 120 W) for 1 to 3 minutes. Adjusting the dispersion concentration to 12,000 to 20,000 particles/μl and using the above flow type particle image analyzer, the circularity distribution of particles having circle-corresponding diameters of from 0.60 μm or more to less than 159.21 μm are measured, provided that, in calculating the average circularity and the circularity standard deviation, particles having particle diameters of from 3.00 μm to 159.21 μm are measured.

The summary of measurement is as follows:

The sample dispersion is passed through channels (extending along the flow direction) of a flat flow cell (thickness: about 200 μm). A strobe and a CCD (charge-coupled device) camera are so fitted as to position oppositely to each other with respect to the flow cell so as to form a light path that passes crosswise. During the flowing of the sample dispersion, the dispersion is irradiated with strobe light at intervals of 1/30 seconds to obtain an image of the particles flowing through the cell, so that a photograph of each particle is taken as a two-dimensional image having a certain range parallel to the flow cell. From the area of the two-dimensional image of each particle, the diameter of a circle having the same area is calculated as the circle-corresponding diameter. The circularity of each particle is calculated from the projected area of the two-dimensional image of each particle and from the circumferential length of the projected image according to the above equation for calculating the circularity.

The magnetic toner according to the present invention contains at least a binder resin, a magnetic material and a release agent, and besides may preferably appropriately be incorporated with a charge control agent and external additives. The binder resin may include vinyl resins, polyester resins, epoxy resins and polyurethane resins, and conventionally known resins may be used without any particular limitations. In particular, vinyl resins and polyester resins are preferred in view of charging performance and fixing performance.

Monomers used when the vinyl resins are produced may include, e.g., styrene; styrene derivatives such as o-methylstyrene, m-methylstyrene, p-methylstyrene, p-methoxystyrene, p-phenylstyrene, p-chlorostyrene, 3,4-dichlorostyrene, p-ethylstyrenee, 2,4-dimethylstyrene, p-n-butylstyrene, p-tert-butylstyrene, p-n-hexylstyrene, p-n-octylstyrene, p-n-nonylstyrene, p-n-decylstyrene and p-n-dodecylstyrene; ethylene unsaturated monoolefins such as ethylene, propylene, butylene and isobutylene; unsaturated polyenes such as butadiene; vinyl halides such as vinyl chloride, vinylidene chloride, vinyl bromide and vinyl fluoride; vinyl esters such as vinyl acetate, vinyl propionate and vinyl benzoate; α-methylene aliphatic monocarboxylates such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; acrylic esters such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate and phenyl acrylate; vinyl ethers such as methyl vinyl ether, ethyl vinyl ether and isobutyl vinyl ether; vinyl ketones such as methyl vinyl ketone, hexyl vinyl ketone and methyl isopropenyl ketone; N-vinyl compounds such as N-vinylpyrrole, N-vinylcarbazole, N-vinylindole and N-vinylpyrrolidone; vinylnaphthalenes; and acrylic acid or methacrylic acid derivatives such as acrylonitrile, methacrylonitrile and acrylamide; as well as α,β-unsaturated esters and diesters of dibasic acids. Any of these vinyl monomers may be used alone or in combination of two or more monomers.

Of these, monomers may preferably be used in such a combination that may give a styrene copolymer and a styrene-acrylic copolymer.

Also usable as the vinyl resins are polymers or copolymers cross-linked with a cross-linkable monomer as exemplified below.

It may include aromatic divinyl compounds as exemplified by divinylbenzene and divinylnaphthalene; diacrylate compounds linked with an alkyl chain, as exemplified by ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, and the above compounds whose acrylate moiety has been replaced with methacrylate; diacrylate compounds linked with an alkyl chain containing an ether linkage, as exemplified by diethylene glycol diacrylate, triethylene glycol diacrylate, tetraethylene glycol diacrylate, polyethylene glycol #400 diacrylate, polyethylene glycol #600 diacrylate, dipropylene glycol diacrylate, and the above compounds whose acrylate moiety has been replaced with methacrylate; diacrylate compounds linked with a chain containing an aromatic group and an ether linkage, as exemplified by polyoxyethylene(2)-2,2-bis(4-hydroxyphenyl)propane diacrylate, polyoxyethylene(4)-2,2-bis(4-hydroxyphenyl)propane diacrylate, and the above compounds whose acrylate moiety has been replaced with methacrylate; and polyester type diacrylate compounds as exemplified by MANDA (trade name; available from Nippon Kayaku Co., Ltd.).

As polyfunctional cross-linkable monomers, it may include pentaerythritol triacrylate, trimethylolethane triacrylate, trimethylolpropane triacrylate, tetramethylolmethane tetraacrylate, oligoester acrylate, and the above compounds whose acrylate moiety has been replaced with methacrylate; triallylcyanurate, and triallyltrimellitate.

Any of these cross-linkable monomers may preferably be used in an amount of from 0.01 to 10 parts by weight, and preferably from 0.03 to 5 parts by weight, based on 100 parts by weight of other monomer components.

Of these cross-linkable monomers, monomers preferably usable in view of fixing performance and anti-offset properties are aromatic divinyl compounds (in particular, divinylbenzene) and diacrylate compounds linked with a chain containing an aromatic group and an ether linkage.

In the present invention, a homopolymer or copolymer of vinyl monomer, a polyester, a polyurethane, an epoxy resin, polyvinyl butyral, rosin, a modified rosin, a terpene resin, a phenolic resin, an aliphatic or alicyclic hydrocarbon resin or an aromatic petroleum resin may optionally be mixed so as to be used as the binder resin.

In the case when a mixture of two or more types of resins are used as the binder resin, as a more preferable form, those having different molecular weights may preferably be mixed in a suitable proportion.

The binder resin may preferably have a glass transition temperature (Tg) of from 45° C. to 80° C., and more preferably from 55° C. to 70° C., a number-average molecular weight (Mn) of from 2,500 to 50,000 and a weight-average molecular weight (Mw) of from 10,000 to 1,000,000.

As processes for synthesizing vinyl polymers or vinyl copolymers, any of polymerization processes such as bulk polymerization, solution polymerization, suspension polymerization and emulsion polymerization may be used. Where carboxylic acid monomers or acid anhydride monomers are used, it is preferable in view of properties of monomers to use bulk polymerization or solution polymerization.

As a specific example, the following process is available: Using a monomer such as dicarboxylic acid, dicarboxylic anhydride or dicarboxylic monoester, a vinyl copolymer may be obtained by bulk polymerization or solution polymerization. In the solution polymerization, the dicarboxylic acid or dicarboxylic monoester unit may partly be converted into an anhydride by designing conditions for evaporation at the time of solvent evaporation. Also, the vinyl copolymer obtained by bulk polymerization or solution polymerization may be subjected to heat treatment to convert it further into an anhydride. The acid anhydride may also partly be esterified with a compound such as an alcohol.

Conversely, the vinyl copolymer thus obtained may be subjected to hydrolysis treatment to cause its acid anhydride group to undergo ring closure so as to be partly made into a dicarboxylic acid.

Meanwhile, using a dicarboxylic acid monoester monomer, a vinyl copolymer obtained by suspension polymerization or emulsion polymerization may be subjected to heat treatment to convert it into an anhydride, which is then may be subjected to ring opening due to hydrolysis treatment to obtain a dicarboxylic acid from the anhydride. A process may be used in which the vinyl copolymer obtained by bulk polymerization or solution polymerization is dissolved in a monomer and then a vinyl polymer or copolymer is obtained by suspension polymerization or emulsion polymerization, where part of the acid anhydride undergoes ring opening and the dicarboxylic acid unit can be obtained. At the time of polymerization, other resin may be mixed in the monomer, and the resin obtained may be subjected to heat treatment to convert it into an acid anhydride, and the acid anhydride may be esterified by ring-opening alcohol treatment by treating it with weakly alkaline water.

The dicarboxylic acid or dicarboxylic anhydride monomer is strongly alternatingly copolymerizable and hence, in order to obtain a vinyl copolymer in which functional groups such as anhydride and dicarboxylic acid have been dispersed at random, the following process is one of preferred processes. It is a process in which, using a dicarboxylic acid monoester monomer, a vinyl copolymer is obtained by solution polymerization, and this vinyl copolymer is dissolved in the monomer to effect suspension polymerization to obtain the binder resin. In this process, the whole or dicarboxylic acid monoester moiety can be converted into an anhydride by alcohol-removing ring closure to obtain an acid anhydride, controlling treatment conditions at the time of solvent evaporation after the solution polymerization. At the time of suspension polymerization, the acid anhydride group undergoes hydrolysis ring opening and a dicarboxylic acid is obtained.

In conversion into an acid anhydride in the polymer, infrared absorption of carbonyl shifts to a higher wave number side than that of an acid or ester. Thus, the formation or disappearance of an acid anhydride can be ascertained.

In the binder resin thus obtained, the carboxyl group, the anhydride group and the dicarboxylic acid group are uniformly dispersed in the binder resin, and hence they can provide developers with a good charging performance.

As the binder resin, a polyester resin shown below is also preferred.

In the polyester resin, from 45 to 55 mol % in the all components are held by an alcohol component, and from 55 to 45 mol % by an acid component.

As the alcohol component, it may include polyhydric alcohols such as ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, a bisphenol derivative represented by the following Formula (B):

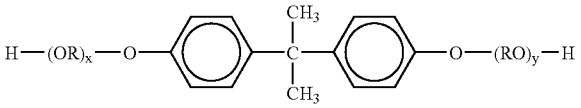

wherein R represents an ethylene group or a propylene group, x and y are each an integer of 1 or more, and an average value of x+y is 2 to 10;

also a diol represented by the following Formula (C).

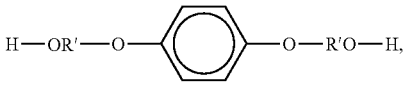

wherein R' represents

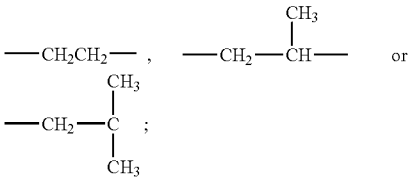

glycerol, sorbitol and sorbitan.

It is preferable that 50 mol % or more of the whole acid component is held by a dibasic carboxylic acid, and the dibasic carboxylic acid may include benzene dicarboxylic acids and anhydrides thereof, such as phthalic acid, terephthalic acid, isophthalic acid and phthalic anhydride; alkyldicarboxylic acids such as succinic acid, adipic acid, sebacic acid and azelaic acid, and anhydrides thereof, as well as succinic acid further substituted with an alkyl group or alkenyl group having 6 to 18 carbon atoms, or anhydrides thereof; unsaturated dicarboxylic acids such as fumaric acid, maleic acid, citraconic acid and itaconic acid, and anhydrides thereof. As a tribasic or higher carboxylic acid, it may include trimellitic acid, pyromellitic acid, benzophenonetetracarboxylic acid, and anhydrides thereof.

A particularly preferred alcohol component of the polyester resin is the bisphenol derivative represented by the above Formula (B). As the acid component, particularly preferred are dicarboxylic acids such as phthalic acid, terephthalic acid, isophthalic acid and anhydrides thereof, succinic acid, n-dodecenylsuccinic acid or anhydrides thereof, fumaric acid, maleic acid and maleic anhydride; and tricarboxylic acids such as trimellitic acid or anhydrides thereof.

A developer using as a binder resin the polyester resin obtained from these acid component and alcohol component has good fixing performance and superior anti-offset properties as a developer for heat-roller fixing.

The polyester resin may preferably have a glass transition temperature of from 50° C. to 75° C., and more preferably from 55° C. to 65° C. It may also preferably have a number-average molecular weight (Mn) of from 1,500 to 50,000, and more preferably from 2,000 to 20,000, and a weight-average molecular weight (Mw) of from 6,000 to 100,000, and more preferably from 10,000 to 90,000.

The glass transition temperature (Tg) of the binder resin is measured according to ASTM D3418-82, using a differential scanning calorimeter (DSC measuring instrument) DSC-7, manufactured by Perkin-Elmer Corporation.

A sample for measurement is precisely weighed in an amount of 5 to 20 mg, preferably 10 mg. This sample is put in an aluminum pan and an empty aluminum pan is used as reference. Measurement is made in a normal-temperature normal-humidity environment at a heating rate of 10° C./min within the measuring temperature range of from 30° C. to 200° C.

In the course of this heating, a main-peak endothermic peak is obtained in the temperature range of from 40° C. to 100° C. The point at which the line at a middle point of the base lines before and after the appearance of the endothermic peak thus obtained and the differential thermal curve intersect is regarded as the glass transition point Tg.

Then, to measure the molecular weight of the binder resin, molecular weight of a chromatogram is measured by GPC (gel permeation chromatography) under the following conditions.

Columns are stabilized in a heat chamber of 40° C. To the columns kept at this temperature, tetrahydrofuran (THF) as a solvent is flowed at a flow rate of 1 ml per minute. A sample is dissolved in THF, and thereafter filtered with a filter of 0.2 μm in pore size, and the resultant filtrate is used as a sample. From 50 to 200 μl of a THF sample solution of resin which has been regulated to have a sample concentration of from 0.05 to 0.6% by weight is injected thereinto to make measurement. In measuring the molecular weight of the sample, the molecular weight distribution the sample has is calculated from the relationship between the logarithmic value of a calibration curve prepared using several kinds of monodisperse polystyrene standard samples and the number of counts. As the standard polystyrene samples used for the preparation of the calibration curve, it is suitable to use samples with molecular weights of 600, 2,100, 4,000, 17,500, 51,000, 110,000, 390,000, 860,000, 2,000,000 and 4,480,000, which are available from Pressure Chemical Co. or Tosoh Corporation, and to use at least about 10 standard polystyrene samples. An RI (refractive index) detector is used as a detector.

As columns, in order to make precise measurement in the region of molecular weight from 1,000 to 2,000,000, it is desirable to use a plurality of commercially available polystyrene gel columns in combination. For example, they may preferably comprise a combination of μ-Styragel 500, 1,000, 10,000 and 100,000, available from Waters Co., and Shodex KA-801, KA-802, KA-803, KA-804, KA-805, KA-806 and KA-807, available from Showa Denko K.K.

The developer (inclusive of the magnetic toner and the non-magnetic color toner) used in the present invention, in order to make its charging performance more stable, may optionally be used in combination with one or two or more charge control agent(s). The charge control agent may preferably be used in an amount of from 0.1 to 10 parts by weight, and more preferably from 0.1 to 5 parts by weight, based on 100 parts by weight of the binder resin.

The charge control agent may include the following.

As charge control agents capable of controlling the developer to be negatively chargeable, organic metal complexes or chelate compounds are effective, which include monoazo metal complexes, metal complexes of aromatic hydroxycarboxylic acids and metal complexes of aromatic dicarboxylic acids. Besides, they include aromatic hydroxycarboxylic acids, aromatic mono- or polycarboxylic acids and metal salts thereof, anhydrides thereof or esters thereof, and phenol derivatives such as bisphenol.

Charge control agents capable of controlling the developer to be positively chargeable include Nigrosine, and modified products thereof, modified with a fatty acid metal salt; quaternary ammonium salts such as tributylbenzylammonium 1-hydroxy-4-naphthosulfonate and tetrabutylammonium teterafluoroborate, and analogues thereof, i.e., onium salts such as phosphonium salts of these, and, as chelate pigments of these, triphenylmethane dyes and lake pigments of these (lake-forming agents may include tungstophosphoric acid, molybdophosphoric acid, tungstomolybdophosphoric acid, tannic acid, lauric acid, gallic acid, ferricyanides and ferrocyanides); metal salts of higher fatty acids; diorganotin oxides such as dibutyltin oxide, dioctyltin oxide and dicyclohexyltin oxide; and diorganotin borates such as dibutyltin borate, dioctyltin borate and dicyclohexyltin borate.

In the magnetic toner used in the present invention, a magnetic material is incorporated which may include iron oxides such as magnetite, maghemite and ferrite, and iron oxides including other metal oxides; metals such as Fe, Co and Ni, or alloys of any of these metals with any of metals such as Al, Co, Cu, Pb, Mg, Ni, Sn, Zn, Sb, Be, Bi, Cd, Ca, Mn, Se, Ti, W and V, and mixtures of any of these.

As specific magnetic materials, they may include triiron tetraoxide ($Fe_3O_4$), iron sesquioxide ($\gamma$-$Fe_2O_3$), zinc iron oxide ($ZnFe_2O_4$), yttrium iron oxide ($Y_3Fe_5O_{12}$) cadmium iron oxide ($CdFe_2O_4$), gadolinium iron oxide ($Gd_3Fe_5O_{12}$), copper iron oxide ($CuFe_2O_4$), lead iron oxide ($PbFe_{12}O_{19}$), nickel iron oxide ($NiFe_2O_4$), neodymium iron oxide ($NdFe_2O_3$), barium iron oxide ($BaFe_{12}O_{19}$), magnesium iron oxide ($MgFe_2O_4$), manganese iron oxide ($MnFe_2O_4$), lanthanum iron oxide ($LaFeO_3$), iron powder (Fe), cobalt powder (Co) and nickel powder (Ni). Any of the above magnetic materials may be used alone or in combination of two or more types. A particularly preferred magnetic material is fine powder of triiron tetraoxide or $\gamma$-iron sesquioxide.

These magnetic materials may preferably be those having an average particle diameter of from 0.05 to 1.00 μm, and a coercive force of from 1.6 to 12.0 kA/m, a saturation magnetization of from 50 to 200 $Am^2/kg$ (preferably from 50 to 100 $Am^2/kg$) and a residual magnetization of from 2 to 20 $Am^2/kg$, as magnetic properties under application of a magnetic field of 795.8 kA/m.

The magnetic material may also preferably be a magnetic iron oxide having an octahedral particle shape. This is because magnetic iron oxide particles having such a shape are particles readily separable from one another, have less agglomerative properties and are uniformly dispersible in the binder resin. Also, such magnetic iron oxide particles have unevenness on particle surfaces, have many faces and ridges and have appropriate angles. Hence, they also have good adhesion to the binder resin, and stand fastened also on the magnetic toner particles, and hence they can be prevented from coming off the magnetic toner particles. This therefore also can prevent image white lines from being caused by the scratching of the photosensitive member due to some magnetic material having come liberated from toner particles.

The magnetic material may be used in an amount of from 20 to 150 parts by weight, and preferably from 40 to 120 parts by weight, based on 100 parts by weight of the binder resin.

In the present invention, one or optionally two or more of release agent(s) may be incorporated in the magnetic toner particles. The release agent may include the following.

Aliphatic hydrocarbon waxes such as low-molecular weight polyethylene, low-molecular weight polypropylene, microcrystalline wax and paraffin wax, oxides of aliphatic hydrocarbon waxes such as polyethylene oxide wax, and block copolymers of these; waxes composed chiefly of a fatty ester, such as carnauba wax, sasol wax and montanic acid ester wax; and those obtained by subjecting part or the whole of a fatty ester to deoxydation treatment, such as deoxidized carnauba wax. It may also include saturated straight-chain fatty acids such as palmitic acid, stearic acid and montanic acid; unsaturated fatty acids such as brassidic acid, eleostearic acid and parinaric acid; saturated alcohols such as stearyl alcohol, aralkyl alcohol, behenyl alcohol, carnaubyl alcohol, ceryl alcohol and melissyl alcohol; long-chain alkyl alcohols; polyhydric alcohols such as sorbitol; fatty amides such as linolic acid amide, oleic acid amide and lauric acid amide; saturated fatty bisamides such as methylenebis(stearic acid amide), ethylenebis(capric acid amide), ethylenebis(lauric acid amide) and hexamethylenebis (stearic acid amide); unsaturated fatty amides such as ethylenebis(oleic acid amide), hexamethylenebis(oleic acid amide), N,N'-dioleyladipic acid amide and N,N'-dioleylsebacic acid amide; aromatic bisamides such as m-xylenebis (stearic acid amide) and N,N'-distearylisophthalic acid amide; fatty metal salts (what is commonly called metal soap) such as calcium stearate, calcium laurate, zinc stearate and magnesium stearate; grafted waxes obtained by grafting vinyl monomers such as styrene or acrylic acid to fatty acid hydrocarbon waxes; partially esterified products of polyhydric alcohols with fatty acids, such as monoglyceride behenate; and methyl esterified products having a hydroxyl group, obtained by hydrogenation of vegetable fats and oils.

The release agent may preferably be used in an amount of from 0.1 to 20 parts by weight, and more preferably from 0.5 to 10 parts by weight, based on 100 parts by weight of the binder resin.

Usually, the release agent may be incorporated into the binder resin by a method in which a resin is dissolved in a solvent and, raising the temperature of the resin solution, the release agent is added and mixed therein with stirring, or a method in which they are mixed at the time of kneading so as to be incorporated into the binder resin.

The release agent may also preferably have a maximum endothermic peak temperature of from 65° C. to 130° C., and more preferably from 80° C. to 125° C., at the time of heating as measured with a differential scanning calorimeter (DSC). If it has a maximum endothermic peak temperature of less than 65° C., the toner may have a low viscosity to tend to cause toner adhesion to photosensitive member in high-speed copying machines. If it has a maximum endothermic peak temperature of more than 130° C., the toner may have a low low-temperature fixing performance.

The maximum endothermic peak temperature of the release agent may be determined by making measurement according to ASTM D3418-82, using a differential scanning calorimeter (DSC measuring instrument) DSC-7, manufactured by Perkin-Elmer Corporation.

A sample for measurement is precisely weighed in an amount of 5 to 20 mg, preferably 10 mg. This sample is put in an aluminum pan and an empty aluminum pan is used as reference. Measurement is made in a normal-temperature normal-humidity environment at a heating rate of 10° C./min within the measuring temperature range of from 30° C. to 200° C.

In the course of second-time heating, a maximum endothermic peak main-peak endothermic peak is obtained in the temperature range of from 40° C. to 100° C., and the temperature at that point is used as the maximum endothermic peak temperature of the release agent.

In regard to the non-magnetic color toners according to the present invention, the binder resin, the charge control agent, the release agent and so forth which have been exemplified in the description of the magnetic toner may likewise be used, provided that the magnetic material is not used in the non-magnetic color toners, and colorants are used instead. These colorants may each preferably be used in an amount of from 1 to 15 parts by weight, and more preferably from 2 to 10 parts by weight, based on 100 parts by weight of the binder resin. The colorants may include the following.

As yellow colorants used for a yellow toner, they may include compounds typified by condensation azo compounds, isoindolinone compounds, anthraquinone compounds, azo metal complexes, methine compounds and allylamide compounds. Stated specifically, C.I. Pigment Yellow 12, 13, 14, 15, 17, 62, 74, 83, 93, 94, 95, 97, 109, 110, 111, 120, 127, 128, 129, 147, 155, 168, 174, 176, 180, 181 and 191 are preferably used.

As magenta colorants used for a magenta toner, they may include condensation azo compounds, diketopyrrolopyrrole compounds, anthraquinone compounds, quinacridone compounds, basic dye lake compounds, naphthol compounds, benzimidazolone compounds, thioindigo compounds and perylene compounds. Stated specifically, C.I. Pigment Red 2, 3, 5, 6, 7, 23, 48:2, 48:3, 48:4, 57:1, 81:1, 122, 144, 146, 166, 169, 177, 184, 185, 202, 206, 220, 221 and 254 and C.I. Pigment Red 19 are particularly preferred.

As cyan colorants used for a cyan toner, they may include C.I. Pigment Blue 1, 7, 15, 15:1, 15:2, 15:3, 15:4, 60, 62 and 66. Among these, C.I. Pigment Blue 15:3 is particularly preferred because both coloring power and OHP transparency are satisfied.

The magnetic toner and the non-magnetic color toners may each have a fluidity improver. The fluidity improver is an agent which can improve the fluidity of the toners by its external addition to toner particles, as seen in comparison before and after its addition. For example, it may include fluorine resin powders such as fine vinylidene fluoride powder and fine polytetrafluoroethylene powder; and fine silica powders such as wet-process silica and dry-process silica, fine titanium oxide powders and fine alumina powder, and treated silica, titanium oxide and alumina powders obtained by subjecting these fine powders to surface treatment with a silane coupling agent, a titanium coupling agent or a silicone oil.

A preferred fluidity improver is fine powder produced by vapor phase oxidation of a silicon halide, which is called dry-process silica or fumed silica. For example, it utilizes heat decomposition oxidation reaction in oxyhydrogen frame of silicon tetrachloride gas. The reaction basically proceeds as follows.

$$SiCl_4+2H_2+O_2 \rightarrow SiO_2+4HCl$$

In this production step, it is also possible to use other metal halide such as aluminum chloride or titanium chloride together with the silicon halide to obtain a composite fine powder of silica with other metal oxide, and the silica includes these as well. As to its particle diameter, it is preferable to use fine silica powder having an average primary particle diameter within the range of from 0.001 μm to 2 μm, and particularly preferably within the range of from 0.002 μm to 0.2 μm.

Commercially available fine silica powders produced by the vapor phase oxidation of silicon halides may include, e.g., those which are on the market under the following trade names.

Aerosil 130, 200, 300, 380, TT600, MOX170, MOX80, COK84 (Aerosil Japan, Ltd.);

Ca—O—SiL M-5, MS-7, MS-75, HS-5, EH-5 (CABOT Co.);

Wacker HDK N20, V15, N20E, T30, T40 (WACKER-CHEMIE GMBH);

D-C Fine Silica (Dow-Corning Corp.); and

Fransol (Franzil Co.).

It is also more preferable to use treated fine silica powder obtained by making hydrophobic the fine silica powder produced by vapor phase oxidation of a silicon halide. In the treated fine silica powder, a fine silica powder is particularly preferred which has been so treated that its hydrophobicity as measured by a methanol titration test shows a value within the range of from 30 to 80.

As methods for making hydrophobic, the fine silica powder may be made hydrophobic by chemical treatment with an organosilicon compound capable of reacting with or physically adsorbing the fine silica powder. As a preferable method, the fine silica powder produced by vapor phase oxidation of a silicon halide may be treated with an organosilicon compound.

The organosilicon compound may include hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilyl mercaptan, trimethylsilyl mercaptan, triorganosilyl acrylate, vinyldimethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and a dimethylpolysiloxane having 2 to 12 siloxane units per molecule and containing a hydroxyl group bonded to each Si in its units positioned at the terminals. It may further include silicone oils such as dimethylsilicone oil. Any of these may be used alone or in the form of a mixture of two or more types.

Silane coupling agents having a nitrogen atom, such as aminopropyltrimethoxysilane, aminopropyltriethoxysilane, dimethylaminopropyltrimethoxysilane, diethylaminopropyltrimethoxysilane, dipropylaminopropyltrimethoxysilane, dibutylaminopropyltrimethoxysilane, monobutylaminopropyltrimethoxysilane, dioctylaminopropyltrimethoxysilane, dibutylaminopropylmethyldimethoxysilane, dibutylaminopropylmonomethoxysilane, dimethylaminophenyltriethoxysilane, trimethoxylsilyl-γ-propylphenylamine, and trimethoxylsilyl-γ-propylbenzylamine may also be used alone or in combination. As a preferred silane coupling agent, it may include hexamethyldisilazane (HMDS).

As a preferred silicone oil used in the present invention, one having a viscosity at 25° C. of from 0.5 to 10,000 $mm^2/s$, preferably from 1 to 1,000 $mm^2/s$, and more preferably from 10 to 200 $mm^2/s$ may be used. For example, dimethylsilicone oil, methylphenylsilicone oil, α-methylstyrene modified silicone oil, chlorophenylsilicone oil and fluorine modified silicone oil are particularly preferred. As methods for the treatment with silicone oil, available are, e.g., a method in which the fine silica powder treated with a silane coupling agent and the silicone oil are directly mixed by means of a mixing machine such as a Henschel mixer; a method in which the silicone oil is sprayed on the fine silica powder serving as a base; and a method in which the silicone oil is first dissolved or dispersed in a suitable solvent, and then the fine silica powder is mixed, followed by removal of the solvent.

In the fine silica powder treated with silicone oil, it is more preferable that the fine silica powder having been treated with the silicone oil is heated to 200° C. or more (preferably 250° C. or more) in an inert gas to make surface coatings stable.

In the present invention, preferred are those treated by a method in which the fine silica powder is beforehand treated with the silane coupling agent and thereafter treated with the silicone oil, or a method in which the fine silica powder is simultaneously treated with the silane coupling agent and silicone oil.

As the fluidity improver, those having a specific surface area of 30 $m^2/g$ or more, and preferably 50 $m^2/g$ or more, as measured by the BET method utilizing nitrogen absorption provides good results. The fluidity improver may preferably be used in an amount of from 0.01 to 8 parts by weight, and preferably from 0.1 to 4 parts by weight, based on 100 parts by weight of the toner particles.

To the magnetic toner and non-magnetic color toners used in the present invention, an inorganic fine powder other than the above fluidity improver may be added as a cleaning auxiliary which more improves abrasion effect and cleaning performance. In particular, it is preferable for the magnetic toner to be incorporated with the inorganic fine powder. Such an inorganic fine powder is an agent which can more improve the abrasion effect and cleaning performance by its external addition to toner particles, as seen in comparison before and after its addition. Inorganic fine powders usable in the present invention may include titanates and/or silicates of magnesium, zinc, cobalt, manganese, strontium, cerium, calcium, barium and so forth. Of these, an inorganic fine powder represented by the following formula is particularly preferred in view of advantages that it has superior abrasion effect and improves cleaning performance.

$$[M_1]_a[M_2]_bO_c$$

wherein $M_1$ represents a metallic element selected from the group consisting of Sr, Mg, Zn, Co, Mn, Ca, Ba and Ce; $M_2$ represents any of metallic elements Ti and Si; a represents an integer of 1 to 9; b represents an integer of 1 to 9; and c represents an integer of 3 to 9.

Strontium titanate ($SrTiO_3$), calcium titanate ($CaTiO_3$), strontium silicate ($SrSiO_3$) and barium titanate ($BaTiO_3$) are preferred because the effect of the present invention can more be brought out.

The inorganic fine powder used in the present invention may preferably be, e.g., a powder obtained by forming a material by sintering, and mechanically pulverizing the material, followed by air classification to have the desired particle size distribution.

In the magnetic toner and non-magnetic color toners according to the present invention, the coarse magnetic particles are contained in the stated proportion. Accordingly, the above inorganic fine powder can bring a more satisfactory effect by its addition in an amount of from 0.1 to 6 parts by weight, and preferably from 0.2 to 5.5 parts by weight, based on 100 parts by weight of the toner particles.

As a method for obtaining the magnetic toner used in the present invention, it is preferable that the coarse magnetic particles not passing through a mesh with an opening of 34 μm are added to the magnetic toner having a weight-average particle diameter of from 4.0 μm to 10.0 μm, in an appropriate quantity in the course of a production process or at the last of the production process.

As a production apparatus for obtaining the magnetic toner and the magnetic particles, commonly available toner production apparatus may be used without any particular limitations. Particularly preferred is a production apparatus that enables easy control of the desired particle diameter and circularity.

As a specific production method, the binder resin, the magnetic material and the release agent, with addition of the charge control agent and so forth as other additives, are dry-process mixed by means of a mixing machine such as a Henschel mixer or a ball mill, then the mixture is melt-kneaded by means of a heat kneading machine such as a kneader, a roll mill or an extruder to make resins melt one another, the melt-kneaded product obtained is cooled to solidify, thereafter the solidified product is crushed to obtain a "crushed product A". This crushed product A is finely pulverized by means of an impact type air grinding machine such as Jet Mill, Micron Jet or IDS-type Mill or a mechanical grinding machine such as Criptron, Turbo Mill or Inomizer. The finely pulverized product obtained is classified by means of an air classifier or the like to obtain a "classified product B" having the desired particle size distribution. Further, the crushed product A is median-pulverized by means of ACM Pulverizer, MVM Vertical Mill or the like and the median-pulverized product obtained is classified by means of an air classifier or the like to obtain "magnetic particles C-1" having the desired particle size distribution. In the classified product B, the magnetic particles C-1 are blended in an appropriate quantity, and thereafter the inorganic fine powders such as the fluidity improver and the abrasive are externally mixed. The mixture obtained is introduced into a sifter, and agglomerates or the like in the toner are sifted. Thus, the magnetic toner used in the present invention can be obtained.

As another method, in place of the use of the magnetic particles C-1 in the above method, "magnetic particles C-2" may also be used which are obtained by removing coarse particles by means of an air sifter such as High Bolter, from coarse powder among fine powder and coarse powder which are obtained when the classified product B is obtained.

As the mixing machine used when toner raw materials are mixed, it may include, e.g., Henschel Mixer (manufactured by Mitsui Mining & Smelting Co., Ltd.); Super Mixer (manufactured by Kawata MFG Co., Ltd.); Conical Ribbon Mixer (manufactured by Y.K. Ohkawara Seisakusho); Nauta Mixer, Turbulizer and Cyclomix (manufactured by Hosokawa Micron Corporation); Spiral Pin Mixer (manufactured by Pacific Machinery & Engineering Co., Ltd.); and Rhedige Mixer (manufactured by Matsubo Corporation). As the kneading machine, it may include KRC Kneader (manufactured by Kurimoto, Ltd.); Buss-Kneader (manufactured by Coperion Buss Ag.); TEM-type Extruder (manufactured by Toshiba Machine Co., Ltd.); TEX Twin-screw Extruder (manufactured by The Japan Steel Works, Ltd.); PCM Kneader (manufactured by Ikegai Corp.); Three-Roll Mill, Mixing Roll Mill and Kneader (manufactured by Inoue Manufacturing Co., Ltd.); Kneadex (manufactured by Mitsui Mining & Smelting Co., Ltd.); MS-type Pressure Kneader, Kneader-Ruder (manufactured by Moriyama Manufacturing Co., Ltd.); and Banbury Mixer (manufactured by Kobe Steel, Ltd.).

As the grinding machine used as a finely pulverizing means, it may include Counter Jet Mill, Micron Jet and Inomizer (manufactured by Hosokawa Micron Corporation); IDS-type Mill and PJM Jet Grinding Mill (manufactured by Nippon Pneumatic MFG Co., Ltd.); Cross Jet Mill (manufactured by Kurimoto, Ltd.); Ulmax (manufactured by Nisso Engineering Co., Ltd.); SK Jet O-Mill (manufactured by Seishin Enterprise Co., Ltd.); Criptron (manufactured by Kawasaki Heavy Industries, Ltd); and Turbo Mill (manufactured by Turbo Kogyo Co., Ltd.). As a pulverizing means for producing the magnetic particles, ACM Pulverizer (manufactured by Hosokawa Micron Corporation), MVM Vertical Mill and so forth are preferred. Even the above grinding machine used as a finely pulverizing means can obtain the magnetic particles used in the present invention by making pulverization conditions proper.

As the classifier, it may include Classyl, Micron Classifier and Spedic Classifier (manufactured by Seishin Enterprise Co., Ltd.); Turbo Classifier (manufactured by Nisshin Engineering Inc.); Micron Separator, Turboprex(ATP) and TSP Separator (manufactured by Hosokawa Micron Corporation); Elbow Jet (manufactured by Nittetsu Mining Co., Ltd.); Dispersion Separator (manufactured by Nippon Pneumatic MFG Co., Ltd.); and YM Microcut (manufactured by Yasukawa Shoji K.K.). As the sifter used to sieve coarse powder and so forth, it may include Ultrasonics (manufactured by Koei Sangyo Co., Ltd.); Rezona Sieve and Gyro Sifter (manufactured by Tokuju Corporation); Vibrasonic Sifter (manufactured by Dulton Company Limited); Sonicreen (manufactured by Shinto Kogyo K.K.); Turbo-Screener (manufactured by Turbo Kogyo Co., Ltd.); Microsifter (manufactured by Makino mfg. co., ltd.); and circular vibrating screens.

Even the above sifter may be used when the coarse particles are removed from the coarse powder obtained in the classification step. However, it is preferable to use the air sifter such as High Bolter (manufactured by Shin Tokyo Kikai K.K.).

As the finely pulverizing means, the grinding mill as described above may be used. However, in recent years, as endeavors at considering environmental problems, in order to reduce the transfer residual toner that may cause an increase in waste toner, it is common to make the shape of toner particles more closely spherical so as to improve the transfer efficiency at the time toner images are transferred from the surface of the photosensitive member to the transfer material. In the case when the air grinding machine such as Jet Mill is used, it is not easy to obtain toner particles having a large circularity, resulting in a low transfer efficiency to make it difficult to achieve the reduction of waste toner. As a countermeasure against this, it is preferable to design pulverization conditions, e.g., to lower throughput and lower pulverization pressure to carry out soft pulverization, or to further add a surface modification treatment step after the fine pulverization or the classification. The surface modification treatment includes "hot spherical treatment" in which a powder is sprayed in a hot-air stream, and treatment making use of mechanical impact force. As spherical treatment making use of impact force, a method is available in which toner particles are pressed against an inner wall of a casing by means of high-speed rotating blades to impart mechanical impact force to toner particles by frictional force and compression force to make them spherical, specifically as in a mechanofusion system manufactured by Hosokawa Micron Corporation or a hybridization system manufactured by Nara Machinery Co., Ltd.

Compared with the air grinding machine, the use of such a mechanical grinding machine enables high-circularity toner particles to be obtained with ease. Here, the particle size and circularity of toner particles can be controlled by making microadjustment of a cooling unit, the peripheral speed and load of a rotor of the mechanical grinding machine or the minimum space between the rotor and a stator of the grinding machine.

Stated specifically, in producing toners using the mechanical grinding machine, in-machine load may be made higher and in-machine temperature may be raised where the circularity of toner particles should be made higher, and conversely in-machine load may be lowered and in-machine temperature may be dropped where the circularity of toner particles should be lowered. This enables easy control of the circularity.

The non-magnetic color toners according to the present invention may just as well be produced by the melt-kneading and pulverization process like the process for producing the magnetic toner. However, a suspension polymerization process, a solution suspension process and an emulsion agglomeration process are preferred, by which particles having a higher circularity can be obtained with ease.

In particular, a suspension polymerization process may preferably be used in which the colorant, the release agent and optionally other toner particle materials are dissolved or dispersed in a polymerizable monomer constituting the binder resin to prepare a polymerizable monomer composition, where the polymerizable monomer composition is dispersed in a suitable dispersion medium and polymerization is carried out using a polymerization initiator to obtain toner particles. As the polymerizable monomer used when the non-magnetic color toners according to the present invention are produced by the suspension polymerization process, a vinyl type polymerizable monomer capable of radical polymerization may be used. As the vinyl type polymerizable monomer, a monofunctional polymerizable monomer or a polyfunctional polymerizable monomer may be used.

The monofunctional polymerizable monomer may include styrene; styrene derivatives such as α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene and p-phenylstyrene; acrylate type polymerizable monomers such as methyl acrylate, ethyl acrylate, n-propyl acrylate, iso-propyl acrylate, n-butyl acrylate, iso-butyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethyl phosphate ethyl acrylate, diethyl phosphate ethyl acrylate, dibutyl phosphate ethyl acrylate and 2-benzoyloxyethyl acrylate; methacrylate type polymerizable monomers such as methyl methacrylate, ethyl methacrylate, n-propyl methacrylate, iso-propyl methacrylate, n-butyl methacrylate, iso-butyl methacrylate, tert-butyl methacrylate, n-amyl methacrylate, n-hexyl methacrylate, 2-ethylhexyl methacrylate, n-octyl methacrylate, n-nonyl methacrylate, diethyl phosphate ethyl methacrylate and dibutyl phosphate ethyl methacrylate; methylene aliphatic monocarboxylates; vinyl esters such as vinyl acetate, vinyl propionate, vinyl butyrate, vinyl benzoate and vinyl formate; vinyl ethers such as methyl vinyl ether, ethyl vinyl ether and isobutyl vinyl ether; and vinyl ketones such as methyl vinyl ketone, hexyl vinyl ketone and isopropyl vinyl ketone.

The polyfunctional polymerizable monomer may include diethylene glycol diacrylate, triethylene glycol diacrylate, tetraethylene glycol diacrylate, polyethylene glycol diacrylate, 1,6-hexanediol diacrylate, neopentyl glycol diacrylate, tripropylene glycol diacrylate, polypropylene glycol diacrylate, 2,2'-bis[4-(acryloxy-diethoxy)phenyl] propane, trimethyrolpropane triacrylate, tetramethyrolmethane tetraacrylate, ethylene glycol dimethacrylate, diethylene glycol dimethacrylate, triethylene glycol dimethacrylate, tetraethylene glycol dimethacrylate, polyethylene glycol dimethacrylate, 1,3-butylene glycol dimethacrylate, 1,6-hexanediol dimethacrylate, neopentyl glycol dimethacrylate, polypropylene glycol dimethacrylate, 2,2'-bis[4-(methacryloxy-diethoxy)phenyl]propane, 2,2'-bis[4-(methacryloxy-polyethoxy)phenyl]propane, trimethyrolpropane trimethacrylate, tetramethyrolmethane tetramethacrylate, divinyl benzene, divinyl naphthalene, and divinyl ether.

In the present invention, the above monofunctional polymerizable monomer may be used alone or in combination of two or more, or the above monofunctional polymerizable monomer and polyfunctional polymerizable monomer may be used in combination. The polyfunctional polymerizable monomer may also be used as a cross-linking agent.

As the polymerization initiator used in polymerizing the above polymerizable monomer, an oil-soluble initiator and/or a water-soluble initiator may be used. For example, the oil-soluble initiator may include azo compounds such as 2,2'-azobisisobutyronitrile), 2,2'-azobis-(2,4-dimethylvaleronitrile), 1,1'-azobis-(cyclohexane-1-carbonitrile), and 2,2'-azobis-4-methoxy-2,4-dimethylvaleronitrile; and peroxide type initiators such as acetylcyclohexylsulfonyl peroxide, diisopropyl peroxycarbonate, decanonyl peroxide, lauroyl peroxide, stearoyl peroxide, propionyl peroxide, acetyl peroxide, t-butyl peroxy-2-ethylhexanoate, benzoyl peroxide, t-butyl peroxyisobutyrate, cyclohexanone peroxide, methyl ethyl ketone peroxide, dicumyl peroxide, t-butyl hydroperoxide, di-t-butyl peroxide, and cumene hydroperoxide.

The water-soluble initiator may include ammonium persulfate, potassium persulfate, 2,2'-azobis(N,N'-diemthyleneisobutyloamidine) hydrochloride, 2,2'-azobis(2-amino-dipropane) hydrochloride, azobis(isobutyloamidine) hydrochloride, sodium 2,2'-azobisisobutylonitrile sulfonate, and ferrous sulfate or hydrogen peroxide.

In the present invention, a chain transfer agent, a polymerization inhibitor and so forth which are known in the art may further be added in order to control the degree of polymerizing the polymerizable monomer.

As the cross-linking agent used in the present invention, a compound having at least two polymerizable double bonds may be used. For example, it may include aromatic divinyl compounds such as divinyl benzene and divinyl naphthalene; carboxylic acid esters having two double bonds, such as ethylene glycol diacrylate, ethylene glycol dimethacrylate and 1,3-butanediol dimethacrylate; divinyl compounds such as divinyl aniline, divinyl ether, divinyl sulfide and divinyl sulfone; and compounds having at least three vinyl groups. Any of these may be used alone or in the form of a mixture.

The non-magnetic color toners may each be used as a non-magnetic one-component developer, and may also each be blended with a magnetic carrier so as to be used as a two-component developer. As the magnetic carrier, usable are known magnetic carriers such as magnetic-material particles themselves, a coated carrier obtained by coating magnetic-material particles with a resin, and a magnetic-material-dispersed resin carrier obtained by dispersing magnetic-material particles in resin particles. As the magnetic-material particles for the carrier, usable are, e.g., surface-oxidized or unoxidized particles of a metal such as iron, lithium, calcium, magnesium, nickel, copper, zinc, cobalt, manganese, chromium or rare earth metals.

The coated carrier obtained by coating magnetic-material particles with a resin is particularly preferred in a developing method in which an alternating bias is applied to the developing sleeve. As coating methods, any conventionally known methods may be used, such as a method in which a coating fluid prepared by dissolving or suspending a coating material such as a resin in a solvent is made to adhere to carrier core particle surfaces, and a method in which magnetic carrier core particles and a coating material are mixed in a powdery form.

Coating materials with which the magnetic carrier core particle surfaces are coated may include silicone resins, polyester resins, styrene resins, acrylic resins, polyamides, polyvinyl butyral, and aminoacrylate resins. Any of these may be used alone or in plurality. Such coating materials may preferably be in a treatment quantity of from 0.1 to 30% by weight, and more preferably from 0.5 to 20% by weight, based on the weight of the carrier core particles.

The magnetic carrier may preferably have a volume-average particle diameter of from 10 μm to 100 μm, and more preferably from 20 μm to 70 μm.

In the case when the non-magnetic color toner and the magnetic carrier are blended to prepare the two-component developer, good results are usually obtainable when their blending ratio is controlled to be from 2 to 15% by weight, and preferably from 4 to 13% by weight, as toner concentration in the developer. If the toner concentration is less than 2% by weight, image density tends to decrease. If it is more than 15% by weight, fog or in-machine toner scatter tends to occur.

The non-magnetic color toner may preferably have an average circularity larger than the average circularity of the magnetic particles passing through a mesh with an opening of 34 μm in the magnetic toner. This is because, in color-toners, a high transfer efficiency is required in order to obtain highly minute images.

The image forming apparatus of the present invention is described below.

In an image forming apparatus which forms a full-color image by superimposing a plurality of color toner images, an image forming apparatus making use of an intermediate transfer member is conventionally proposed for the purpose of obtaining full-color images free of any color misregistration. An image forming apparatus suited for the present invention is shown in FIG. 1 as an example.

Figure 3:
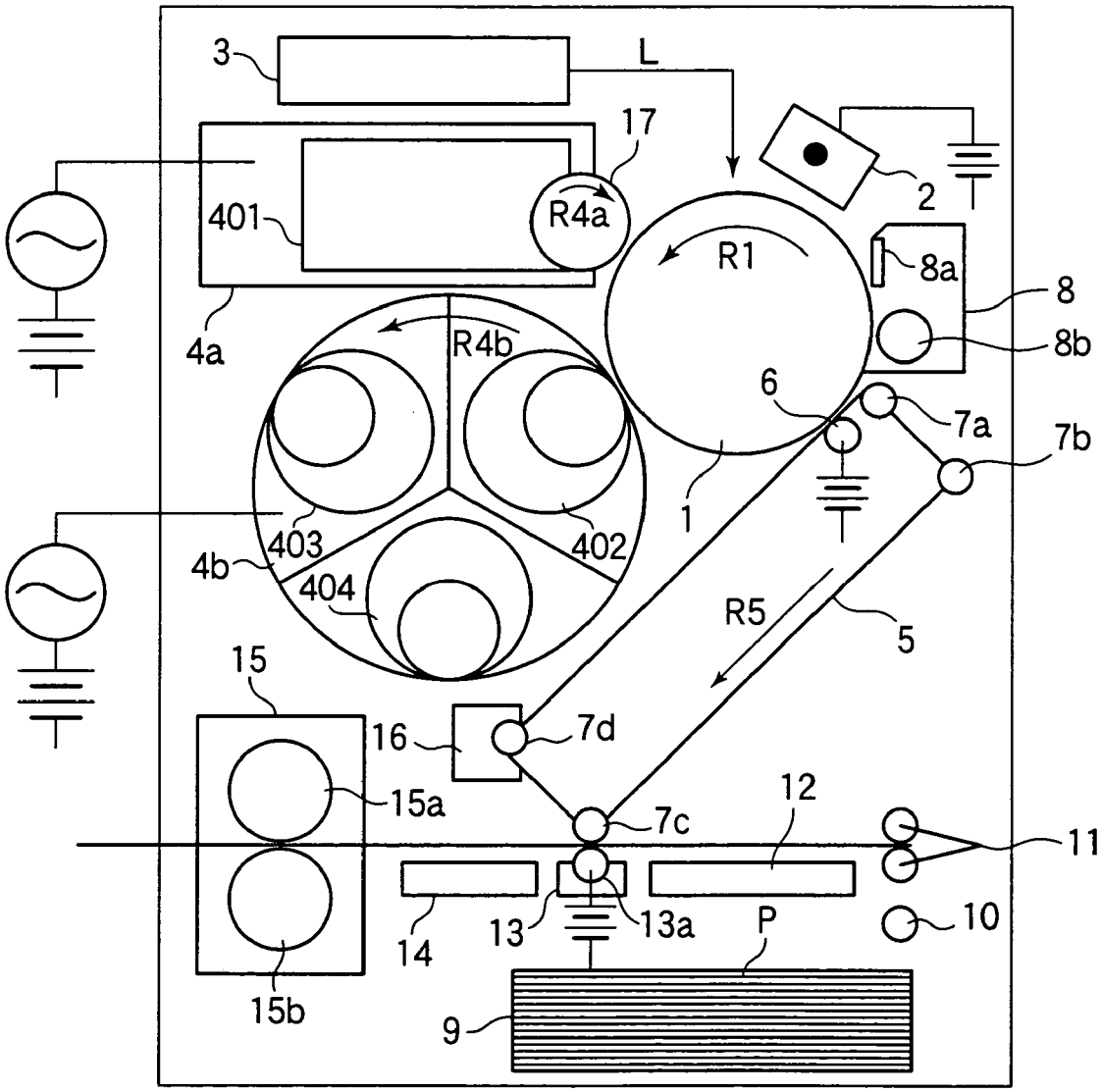
FIG. 3 is a schematic view showing an example an image forming apparatus suited for the present invention.

This image forming apparatus is a copying machine, or a laser beam printer, utilizing an electrophotographic process. How the image forming apparatus shown in FIG. 3 is constructed and operated is simply described below.

Figure 4:
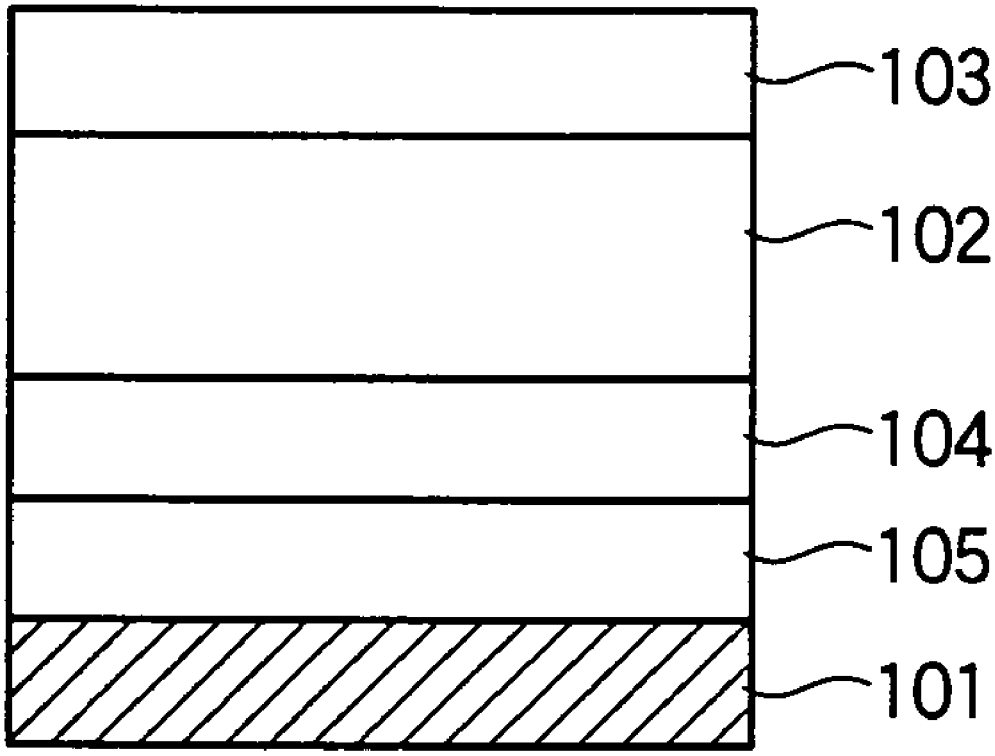
FIG. 4 is a diagrammatic view of the layer construction of an amorphous silicon photosensitive member.

In the interior of the apparatus main body (hereinafter "machine interior"), a rotating drum type electrophotographic photosensitive member 1 (hereinafter "photosensitive drum") is disposed as a latent-image bearing member. Here, an amorphous silicon photosensitive member is used. A diagrammatic view of its layer construction is shown in FIG. 4. Reference numeral 101 denotes a conductive support made of Al or the like; 104, a charge injection blocking layer for blocking electric charges from being injected from the conductive support 101; 102, a photoconductive layer constituted of at least an amorphous silicon type material and showing photoconductivity; 103, a surface protective layer for protecting the photoconductive layer 102; and 105, a long-wavelength light absorption layer for preventing light from reflecting from the conductive support 101.

The photosensitive drum 1 is rotatingly driven in the direction of an arrow R1 at a stated peripheral speed (process speed), and a process of forming respective images as described later is repeated on its surface.

The photosensitive drum 1 is, in the course of its rotation in the direction of the arrow R1, charging-treated to a stated polarity and a stated surface potential by means of a charging assembly 2 such as a corona charging assembly, and then subjected to imagewise exposure L by an exposure means 3 (an image formation exposure optical system based on color separation of a color original image, or a scanning exposure optical system using a laser scanner that outputs laser beams modulated in accordance with time-sequential electrical digital pixel signals of image information), so that an electrostatic latent image is formed which corresponds to a color component image (e.g., a magenta M component image) of an intended full-color image.

As the intermediate transfer member, an intermediate transfer belt is used. An intermediate transfer belt 5 is put around and stretched over one conductive roller 6 and four turn rollers 7*a*, 7*b*, 7*c* and 7*d*, five rollers in total. The conductive roller 6 holds the intermediate transfer belt 5 in the state toner to be prepared is brought into pressure contact with the photosensitive drum 1 under a stated pressing force. The intermediate transfer belt 5 is rotatingly driven in the direction of an arrow R5 at the same peripheral speed as the photosensitive drum 1, and a transfer bias with a polarity (positive in this example) reverse to that of the toner charge polarity (negative) of a toner image formed and held on the photosensitive drum 1 is applied to the conductive roller 6 by a bias power source.

The intermediate transfer belt 5 is, e.g., a dielectric film of polyester, polyethylene or the like, or a dielectric film of a composite-layer type, obtained by backing with a conductor on the back (inner surface side) of a medium-resistance rubber or the like. The first-color magenta toner image formed and held on the photosensitive drum 1 is, in the course it passes through a transfer zone, successively transferred on to the outer surface of the intermediate transfer belt 5 by the aid of an electric field formed by applying the transfer bias to the conductive roller 6.

The image forming apparatus has a developing unit 4*a* for black (Bk) which has the magnetic toner described above, disposed stationarily on the upstream side of the photosensitive drum 1 in its rotational direction (arrow R1 direction), and a rotary unit 4*b* having developing assemblies for other three colors, disposed rotatably on the downstream side. The rotary unit 4*b* is constituted of three developing assemblies supported in this rotary unit, namely, developing assemblies 402, 403 and 404 holding therein magenta (M), cyan (C) and yellow (Y) color toners, respectively, which are the non-magnetic color toners described above (hereinafter "M developing assembly 402", "C developing assembly 403" and "Y developing assembly 404", respectively).

A black developing assembly (hereinafter "Bk developing unit") 401 set to the developing unit 4*a* is stationarily disposed between the upstream-side exposure zone and the downstream-side rotary unit 4*b* in such a way that it separates these. It has a developing sleeve 17 which is rotatingly driven in the direction of an arrow R4*a* in respect to the rotational direction R1 of the photosensitive drum 1.

How the image formation is operated in the image forming apparatus of this example shown in FIG. 3 is described below. Incidentally, FIG. 3 shows a state in which, among the three developing assemblies in the rotary developing unit 4*b*, the M developing assembly 402 is kept stand-by at the present position. Also, a cleaning unit 8 is provided therein with a cleaning blade 8*a* kept in contact with the photosensitive drum 1 and, as a cleaning auxiliary means, a magnet roller 8*b* on the upstream side in respect to the cleaning blade in the rotational direction of the photosensitive drum 1.

The first-color magenta latent image is formed on the photosensitive drum 1, and is developed in the state as shown in FIG. 3. The magenta toner image thus developed with a magenta toner by means of the M developing assembly 402 and held on the photosensitive drum 1 is, as the photosensitive drum 1 is rotated in the arrow R1 direction (counterclockwise), successively intermediately transferred to the peripheral surface of the intermediate transfer belt 5. Then, the surface of the photosensitive drum 1 from which the first-color magenta toner image has been transferred is cleaned by means of the cleaning unit 8.

Subsequently, in the same way, development with a second-color cyan toner, a third-color yellow toner and a fourth-color black toner is performed by means of the C developing assembly 403, the Y developing assembly 404 and the Bk developing unit 401, respectively, and then the four toner images (magenta, cyan, yellow and black, respective-color toner images) are superimposingly transferred to the outer surface of the intermediate transfer belt 5, so that a synthesized full-color toner image (electrostatic image) corresponding to an intended full-color image is formed.

Then, a transfer material P such as paper is picked up from a paper feed cassette 9 by means of a paper feed roller 10, and is fed at a given timing through a registration roller pair 11 and a transfer guide 12 to a transfer part constituted of a transfer unit 13 (corona charging assembly) and a turn roller 13*a*.

Here, to the conductive roller 6, a bias (negative in this example) with a polarity reverse to that of the bias applied to the transfer unit (i.e., the same polarity as the charge polarity of the toners) is optionally applied from a bias power source. Further, a transfer bias with a polarity (positive in this example) reverse to that of the toner charge polarity (negative) is applied to the transfer unit 13 by a bias power source when the toner images are transferred to the transfer material P having been fed at a given timing.

Synthesized full-color toner images are successively intermediately transferred onto the intermediate transfer belt 5 by repeating the above series of image formation processes. The synthesized full-color toner images thus transferred are finally transferred to following transfer materials P which come being sent to the transfer part one after another.

Incidentally, upon completion of the transfer process, a transfer bias (negative in this example) with the same polarity as that of the toner charge polarity (negative) is applied to the intermediate transfer belt 5 if necessary.

The transfer material P to which the toner image (synthesized full-color toner image) held on the intermediate transfer belt 5 has been transferred is guided into a fixing assembly 15 through a transport guide 14, where it is subjected to fixing treatment of the toner image by heating and pressing with a fixing roller 15*a* and a pressure roller 15*b* which have been heated and temperature-controlled to a stated value, and then put out of the apparatus as a final full-color image formed matter.

Meanwhile, the intermediate transfer belt 5 from which the toner images have been transferred is cleaned by means of a belt cleaning unit 16. The belt cleaning unit 16 is a cleaning unit for the intermediate transfer belt 5, and is usually kept in a non-operating state in respect to the intermediate transfer belt 5. Upon completion of the transfer of the toner images to the transfer material P, however, the belt cleaning unit 16 acts to operate on the outer surface of the intermediate transfer belt 5. Thus, the outer surface of the intermediate transfer belt 5 is cleaned.

Incidentally, depending on the peripheral length of the intermediate transfer belt 5, it is possible to hold the transfer material P in two or more sheets at a time, and form images on two or more sheets in a lump by one rotation of the belt.

The present invention is described below by giving Examples. The present invention is by no means limited to these Examples.

EXAMPLES

Example 1

| (1) Production of Magnetic Toner | (by weight) |
|---|---|
| Polyester resin (polycondensation product of propylene oxide modified bisphenol A with fumaric acid; Tg: 61° C.; Mw: 51,000; Mn: 3,200) | 100 parts |
| Magnetic iron oxide (composition: $Fe_3O_4$; particle shape: octahedral; average particle diameter: 0.24 μm; Hc: 9.4 kA/m; σs: 82.6 $Am^2/kg$; σr: 12.0 $Am^2/kg$) | 90 parts |
| Azo metal complex (available from Hodogaya Chemical Co., Ltd.; trade name: T-77) | 2 parts |
| Fischer-Tropsch wax (available from Nippon Seiro Co., Ltd.; trade name: FT-100; DSC maximum endothermic peak temperature: 98° C.) | 5 parts |

Materials formulated as shown above were well mixed using a Henschel mixer (FM-75 Type, manufactured by Mitsui Miike Engineering Corporation). Thereafter, the mixture obtained was kneaded by means of a twin-screw kneader (PCM-30 Type, manufactured by Ikegai Corp.) set to a temperature of 130° C. The kneaded product obtained was cooled, and then crushed by means of a hammer mill to a size of 1 mm or less to obtain Crushed Product A-1.

This Crushed Product A-1 was finely pulverized by means of a mechanical grinding machine Turbo Mill (T-250 Type, manufactured by Turbo Kogyo Co., Ltd.). The finely pulverized product obtained by pulverization was classified by means of an air classifier (Elbow Jet, manufactured by Nittetsu Mining Co., Ltd.) to obtain Magnetic Toner Particles B-1 with a weight-average particle diameter (D4) of 7.0 μm and an average circularity of 0.925 in 3 μm or larger particles.

Next, the above Crushed Product A-1 was median-pulverized using ACM-30 (manufactured by Hosokawa Micron Corporation). The median-pulverized product obtained was classified by means of the air classifier to obtain Magnetic Particles C-1 with an average circularity of 0.904.

To Magnetic Toner Particles B-1, Magnetic Particles C-1 were little by little so added and mixed that magnetic particles contained in 5 g of toner to be prepared came to a little less than 100 particles, counting the particles by means of the measuring device having a mesh with an opening of 34 μm. To 100 parts by weight of the mixture obtained, 1.0 part by weight of hydrophobic fine silica powder (surface-treated with hexamethyldisilazane and methylsilicone oil; BET specific surface area: 200 $m^2/g$) and 2.0 parts by weight of strontium titanate (weight-average particle diameter: 1.2 μm) were externally added by means of a Henschel mixer, and thereafter these were introduced into a horizontal cyclonic sifter (Ultrasonic Gyro Sifter GSR Type; manufactured by Tokuju Corporation) to carry out sifting to obtain Magnetic Toner 1. As shown in Table 1, Magnetic Toner 1 had a weight-average particle diameter (D4) of 7.1 μm, a ratio thereof to number-average particle diameter (D1), D4/D1, of 1.41 and a true density d of 1.78 $g/cm^3$.

The magnetic particles contained in Magnetic Toner 1 were counted by the method described previously, using the measuring device shown in FIG. 1. As shown in Table 1, in the case when the mesh with an opening of 34 μm was used, 70 particles (the weight of the measuring sample was 5 g) of magnetic particles were ascertained. Then, in the case when the mesh with an opening of 100 μm was used in place of the mesh with an opening of 34 μm, 3 particles (the weight of the measuring sample was 100 g) of magnetic particles were ascertained. The average circularity of the magnetic particles not passing through the mesh with an opening of 34 μm was measured to find that it was 0.904; and the magnetic particles having passed through the mesh with an opening of 34 μm, 0.925.

| (2) Production of Color Developers - Production of Cyan Developer | (by weight) |
|---|---|
| Styrene monomer | 165 parts |
| n-Butyl acrylate monomer | 35 parts |
| Phthalocyanine pigment (C.I. Pigment Blue 15:3) | 14 parts |
| Linear polyester resin (polycondensation product of polyoxypropylene type bisphenol A with phthalic acid; acid value: 8 mg · KOH/g) | 10 parts |
| Aluminum compound of dialkysalicylic acid | 2 parts |
| Ester wax (produced from alkylcarboxylic acid having 22 carbon atoms and alkyl alcohol having 22 carbon atoms; DSC main peak value: 75° C.; half-width: 3° C.) | 30 parts |

A mixture of the above materials was dispersed for 3 hours by means of an attritor, and thereafter 10 parts by weight of a polymerization initiator 2,2'-azobis(2,4-dimethylvaleronitrile) was added to prepare a polymerizable monomer composition. The polymerizable monomer composition was then introduced into a 70° C. aqueous solution prepared by mixing 1,200 parts by weight of water and 7 parts by weight of tricalcium phosphate. Thereafter, the resultant composition was stirred by means of a TK-type homomixer at 10,000 rpm to carry out granulation for 10 minutes. Thereafter, the high-speed stirrer was changed for a stirrer having propeller stirring blades, and the polymerization was continued for 10 hours at 60 rpm. After the polymerization was completed, diluted hydrochloric acid was added to dissolve away the calcium phosphate, further followed by washing and drying to obtain cyan toner particles having a weight-average particle diameter of 6.2 μm. Cross sections of the cyan toner particles obtained were observed to find that they had a structure wherein the ester wax was covered with shell resin.

100 parts by weight of the above cyan toner particles and 1.5 parts by weight of the same hydrophobic fine silica powder as that used in Production of Magnetic Toner were mixed by means of a Henschel mixer to obtain a cyan toner.

To 5 parts by weight of this cyan toner, 95 parts by weight of a ferrite carrier coated with acrylic resin was blended to prepare a cyan developer.

Production of Magenta Developer

A magenta toner was produced and a magenta developer was prepared both in the same manner as Production of Cyan Developer except that the colorant was changed to C.I. Pigment Red 122.

Production of Yellow Developer

A yellow toner was produced and a yellow developer was prepared both in the same manner as Production of Cyan Developer except that the colorant was changed to C.I. Pigment Yellow 17.

Evaluation methods and evaluation criteria are shown below.

(Evaluation of Image Reproduction)

An image reproduction test was conducted using an apparatus having the structure as shown in FIG. 3. As an electrostatic latent image bearing member, an amorphous silicon photosensitive member whose value of average gradient Δa in the range of 10 μm×10 μm was 0.40 was mounted. Among the developing assemblies disposed in four stations in respect to the photosensitive member, three stations were used as two-component developing assemblies having non-magnetic color developers, and one stage as a magnetic one-component (jumping) developing assembly having a magnetic toner. Also, as the photosensitive member cleaning blade, a blade made of polyurethane rubber with a thickness of 2.0 mm (JIS-A hardness: 70 degrees) was brought into contact at a linear pressure of 15 g/cm, and a magnet roller (material: plastic magnet; magnetic flux density: 750 G) was provided on the upstream side of the cleaning blade in the rotational direction of the photosensitive member (space between the magnet roller and the photosensitive member: 1.1 mm; rotational direction: counter direction in respect to the photosensitive member).

As the two-component developing assemblies, aluminum coat sleeves were used as developing sleeves, and the space between each sleeve and the photosensitive member was set to 460 μm. The alternating bias used in development was applied at a peak-to-peak electric-field intensity of 1,300 Vpp and a frequency of 2,000 Hz.

As the one-component developing assembly, a carbon coat sleeve was used as a developing sleeve, and the space between the sleeve and the photosensitive member was set to 240 μm. The alternating bias used in development was applied at a peak-to-peak electric-field intensity of 1,600 Vpp and a frequency of 2,800 Hz.

Magnetic Toner 1 was used as the magnetic toner (black developer). The above cyan developer, magenta developer and yellow developer were used as the yellow, cyan and magenta respective-color developers.

The above developers and image forming apparatus were left overnight (12 hours or more) in a normal-temperature low-humidity environment (23° C./5% RH). After these were left overnight, 100,000-sheet paper feed running test was conducted using an original full-color image with an image percentage of 4% and repeating replenishment of toners. In that course, the developing assembly having the magnetic toner was taken out at intervals of 5,000 sheets, and, using the remaining three-color color developing assemblies, an original full-color image with an image percentage of 25% was printed on 10 sheets. During the running, solid white and solid black images were reproduced while observing the surface of the photosensitive member periodically, to make evaluation on toner adhesion, and on white lines caused by faulty cleaning and scratching of photosensitive member. At the same time, image density and fog were also examined. The results are shown in Table 2.

As to the toner adhesion, solid black images were reproduced after the running test was finished, and judgement by visual observation was made by white spots, which were image defects in solid black images.

Evaluation criteria are shown below.

A: Very good (no toner adhesion is seen on the photosensitive member).

B: Good (toner adhesion is slightly seen on the photosensitive member, but no influence on images).

C: Average (influence of adhesion of toner particles appears slightly on images, but no problem in practical use).

D: Poor (toner particles adhere so greatly that image defects are conspicuous).

The faulty cleaning and the scratching of photosensitive member were also judged by visual observation of the surface of the photosensitive member after running, and by white lines on solid black images. Evaluation criteria are shown below.

A: Very good (neither slip-through of toner particles nor scratching of photosensitive member are seen).

B: Good (slip-through or scratching of photosensitive member is slightly seen, but no influence on images).

C: Average (influence of slip-through or scratching appears slightly on images, but no problem in practical use).

D: Poor (image defects such as vertical lines due to influence of slip-through or scratching are conspicuous).

The image density was visually evaluated according to A to C three ranks, using solid black images.

The fog was visually evaluated according to A to C three ranks, using solid white images.

Example 2

In Production of Magnetic Toner in Example 1, Crushed Product A-1 was obtained by the same procedure. Thereafter, it was finely pulverized using Turbo Mill T-250 Type. When it was finely pulverized, pulverization feed rate was made higher by 5% and the number of revolutions of the rotor of T-250 was made lower by 5% in respect to those in Example 1. The finely pulverized product obtained by pulverization was further classified by means of an air classifier in the same manner as in Example 1 to obtain Magnetic Toner Particles B-2 with a weight-average particle diameter (D4) of 8.3 μm and an average circularity of 0.917 in 3 μm or larger particles.

Next, of fine powder and coarse powder obtained simultaneously in this classification step, the coarse powder was taken to remove its coarse particles by means of an air sifter (High Bolter NR-300 Type, manufactured by Shin Tokyo Kikai K.K.) to obtain Magnetic Particles C-2 with an average circularity of 0.907. Here, a mesh with an opening of 102 μm was used in the sifter.

To Magnetic Toner Particles B-2, Magnetic Particles C-2 were little by little so added and mixed that magnetic particles contained in 5 g of toner to be prepared came to about 200 particles, counting the particles by means of the measuring device having a mesh with an opening of 34 μm. To the mixture obtained, hydrophobic fine silica powder and strontium titanate were externally added in the same manner as in Example 1, and these were introduced into Gyro Sifter to carry out sifting to obtain Magnetic Toner 2. As shown in Table 1, Magnetic Toner 2 had a weight-average particle diameter (D4) of 8.5 μm, a ratio thereof to number-average particle diameter (D1), D4/D1, of 1.72 and a true density d of 1.76 g/cm$^3$. On Magnetic Toner 2, evaluation was made in the same manner as in Example 1. Its physical properties are shown in Table 1, and the results of evaluation in Table 2.

Example 3

Magnetic Toner Particles B-3 with a weight-average particle diameter (D4) of 5.3 μm and an average circularity of 0.930 in 3 μm or larger particles were obtained in the same manner as in Production of Magnetic Toner in Example 1 except that, when finely pulverized by means of Turbo Mill T-250 Type, pulverization feed rate was made lower by 5% and the number of revolutions of the rotor of T-250 was made higher by 5% in respect to those in Example 1.

To Magnetic Toner Particles B-3, Magnetic Particles C-1 obtained in Example 1 were little by little so added and mixed that magnetic particles contained in 5 g of toner to be prepared came to 30 particles or thereabout, counting the particles by means of the measuring device having a mesh with an opening of 34 μm. To the mixture obtained, hydrophobic fine silica powder and strontium titanate were externally added in the same manner as in Example 1, and these were introduced into Gyro Sifter to carry out sifting to obtain Magnetic Toner 3. As shown in Table 1, Magnetic Toner 3 had a weight-average particle diameter (D4) of 5.4 μm, a ratio thereof to number-average particle diameter (D1), D4/D1, of 1.31 and a true density d of 1.78 g/cm$^3$. On Magnetic Toner 3, evaluation was made in the same manner as in Example 1. Its physical properties are shown in Table 1, and the results of evaluation in Table 2.

Example 4

In Example 3, to Magnetic Toner Particles B-3, Magnetic Particles C-1 were little by little so added and mixed that magnetic particles contained in 5 g of toner to be prepared came to a little less than 20 particles, counting the particles by means of the measuring device having a mesh with an opening of 34 μm. To 100 parts by weight of the mixture obtained, 1.0 part by weight of the same hydrophobic fine silica powder as that used in Example 1 was externally added, and these were introduced into Gyro Sifter in the same manner as in Example 1 carry out sifting to to obtain Magnetic Toner 4. As shown in Table 1, Magnetic Toner 4 had a weight-average particle diameter (D4) of 5.3 μm, a ratio thereof to number-average particle diameter (D1), D4/D1, of 1.30 and a true density d of 1.74 g/cm$^3$. On Magnetic Toner 4, evaluation was made in the same manner as in Example 1. Its physical properties are shown in Table 1, and the results of evaluation in Table 2.

Example 5

Magnetic Toner Particles B-4 with a weight-average particle diameter (D4) of 9.1 μm and an average circularity of 0.909 in 3 μm or larger particles were obtained in the same manner as in Example 2 except that, when finely pulverized by means of Turbo Mill T-250 Type, pulverization feed rate was made higher by 10% and the number of revolutions of the rotor of T-250 was made lower by 10% in respect to those in Example 1.

Next, to Magnetic Toner Particles B-4, Magnetic Particles C-2 obtained in Example 2 were little by little so added and mixed that magnetic particles contained in 5 g of toner to be prepared came to a little less than 300 particles, counting the particles by means of the measuring device having a mesh with an opening of 34 μm. To the mixture obtained, hydrophobic fine silica powder and strontium titanate were externally added in the same manner as in Example 1, and these were introduced into Gyro Sifter to carry out sifting to obtain Magnetic Toner 5. As shown in Table 1, Magnetic Toner 5 had a weight-average particle diameter (D4) of 9.4 μm, a ratio thereof to number-average particle diameter (D1), D4/D1, of 1.92 and a true density d of 1.77 g/cm$^3$. On Magnetic Toner 5, evaluation was made in the same manner as in Example 1. Its physical properties are shown in Table 1, and the results of evaluation in Table 2.

Example 6

Crushed Product A-2 was obtained by carrying out mixing, kneading and crushing in the same manner as in Example 1 except that, in place of the Fischer-Tropsch wax, paraffin wax (available from Nippon Seiro Co., Ltd.; trade name: HNP-5; melting point: 62° C.) was used and the magnetic iron oxide was changed to spherical iron oxide particles (composition: $Fe_3O_4$; particle shape: spherical; average particle diameter: 0.28 μm; Hc: 9.1 kA/m; σs: 81.3 Am$^2$/kg; σr: 11.0 Am$^2$/kg). This Crushed Product A-2 was finely pulverized by means of Turbo Mill T-250 Type.

The finely pulverized product obtained by pulverization was classified by means of an air classifier to obtain Magnetic Toner Particles B-5 with a weight-average particle diameter (D4) of 6.1 μm and an average circularity of 0.927 in 3 μm or larger particles. Also, in the same manner as in Example 1, the above Crushed Product A-2 was median-pulverized using ACM-30 (manufactured by Hosokawa Micron Corporation). The median-pulverized product obtained was classified by means of the air classifier to obtain Magnetic Particles C-3 with an average circularity of 0.899.

To Magnetic Toner Particles B-5, Magnetic Particles C-3 were little by little so added and mixed that magnetic particles contained in 5 g of toner to be prepared came to a little less than 20 particles, counting the particles by means of the measuring device having a mesh with an opening of 34 μm. To 100 parts by weight of the mixture obtained, 1.0 part by weight of the same hydrophobic fine silica powder as that used in Example 1 was externally added by means of a Henschel mixer, and thereafter these were introduced into Gyro Sifter in the same manner as in Example 1 to carry out sifting to obtain Magnetic Toner 6. As shown in Table 1, Magnetic Toner 6 had a weight-average particle diameter (D4) of 6.2 μn, a ratio thereof to number-average particle diameter (D1), D4/D1, of 1.90 and a true density d of 1.72 g/cm$^3$. On Magnetic Toner 6, evaluation was made in the same manner as in Example 1. Its physical properties are shown in Table 1, and the results of evaluation in Table 2.

Example 7

Crushed Product A-3 was obtained by carrying out mixing, kneading and crushing in the same manner as in Example 1 except that in place of the Fischer-Tropsch wax, BISCOL (available from Sanyo Chemical Industries, Ltd.; melting point: 145° C.). This Crushed Product A-3 was finely pulverized by means of Turbo Mill T-250 Type.

The finely pulverized product obtained by pulverization was classified by means of an air classifier to obtain Magnetic Toner Particles B-6 with a weight-average particle diameter (D4) of 7.5 μm and an average circularity of 0.912 in 3 μm or larger particles. Also, in the same manner as in Example 1, the above Crushed Product A-3 was median-pulverized using ACM-30 (manufactured by Hosokawa Micron Corporation). The median-pulverized product obtained was classified by means of the air classifier to obtain Magnetic Particles C-4 with an average circularity of 0.908.

To Magnetic Toner Particles B-6, Magnetic Particles C-4 were little by little so added and mixed that magnetic particles contained in 5 g of toner to be prepared came to 50 particles or thereabout, counting the particles by means of the measuring device having a mesh with an opening of 34 μm. To 100 parts by weight of the mixture obtained, 1.0 part by weight of the same hydrophobic fine silica powder as that used in Example 1 was externally added by means of a Henschel mixer, and thereafter these were introduced into Gyro Sifter in the same manner as in Example 1 to carry out sifting to obtain Magnetic Toner 7. As shown in Table 1, Magnetic Toner 7 had a weight-average particle diameter (D4) of 7.7 μm, a ratio thereof to number-average particle diameter (D1), D4/D1, of 1.43 and a true density d of 1.73 g/cm$^3$. On Magnetic Toner 7, evaluation was made in the same manner as in Example 1. Its physical properties are shown in Table 1, and the results of evaluation in Table 2.

Example 8

Crushed Product A-4 was obtained by carrying out mixing, kneading and crushing in the same manner as in Production of Magnetic Toner in Example 1 except that the Fischer-Tropsch wax was not used. This Crushed Product A-4 was finely pulverized by means of a jet mill grinding machine (IDS 2 Type, manufactured by Nippon Pneumatic MFG Co., Ltd.)

The finely pulverized product obtained by pulverization was further classified by means of an air classifier in the same manner as in Example 1 to obtain Magnetic Toner Particles B-7 with a weight-average particle diameter (D4) of 5.6 μm and an average circularity of 0.903 in 3 μm or larger particles.

In the same manner as in Example 1, the above Crushed Product A-4 was also median-pulverized using ACM-30 (manufactured by Hosokawa Micron Corporation). The median-pulverized product obtained was classified by means of the air classifier to obtain Magnetic Particles C-5 with an average circularity of 0.909.

To Magnetic Toner Particles B-7, Magnetic Particles C-5 were little by little so added and mixed that magnetic particles contained in 5 g of toner to be prepared came to 20 particles or thereabout, counting the particles by means of the measuring device having a mesh with an opening of 34 μm. To the mixture obtained, hydrophobic fine silica powder and strontium titanate were externally added in the same manner as in Example 1, and these were introduced into Gyro Sifter to carry out sifting to obtain Magnetic Toner 8. As shown in Table 1, Magnetic Toner 8 had a weight-average particle diameter (D4) of 5.6 μm, a ratio thereof to number-average particle diameter (D1), D4/D1, of 1.25 and a true density d of 1.80 g/cm$^3$. On Magnetic Toner 8, evaluation was made in the same manner as in Example 1. Its physical properties are shown in Table 1, and the results of evaluation in Table 2.

Example 9

To Magnetic Toner Particles B-1 obtained in Example 1, Magnetic Particles C-5 obtained in Example 8 were little by little so added and mixed that magnetic particles contained in 5 g of toner to be prepared came to 50 particles or thereabout, counting the particles by means of the measuring device having a mesh with an opening of 34 μm. To the mixture obtained, hydrophobic fine silica powder and strontium titanate were externally added in the same manner as in Example 1, and these were introduced into Gyro Sifter to carry out sifting to obtain Magnetic Toner 9. As shown in Table 1, Magnetic Toner 9 had a weight-average particle diameter (D4) of 7.2 μm, a ratio thereof to number-average particle diameter (D1), D4/D1, of 1.78 and a true density d of 1.78 g/cm$^3$. On Magnetic Toner 9, evaluation was made in the same manner as in Example 1. Its physical properties are shown in Table 1, and the results of evaluation in Table 2.

Comparative Example 1

Magnetic Toner Particles B-8 with a weight-average particle diameter (D4) of 9.8 μm and an average circularity of 0.899 in 3 μm or larger particles were obtained in the same manner as in Example 8 except that the air flow on the coarse powder cut side of the air classifier was made lower by 20%.

To Magnetic Toner Particles B-8 obtained, Magnetic Particles C-5 obtained in Example 8 were little by little so added and mixed that magnetic particles contained in 5 g of toner to be prepared came to a little less than 20 particles, counting the particles by means of the measuring device having a mesh with an opening of 34 μm. Thereafter, to the mixture obtained, hydrophobic fine silica powder and strontium titanate were externally added in the same manner as in Example 1, and these were introduced into Gyro Sifter to carry out sifting to obtain Magnetic Toner 10. As shown in Table 1, Magnetic Toner 10 had a weight-average particle diameter (D4) of 9.8 μm and a ratio thereof to number-average particle diameter (D1), D4/D1, of 2.2, having a broad particle size distribution. It also had a true density d of 1.79 g/cm$^3$. On Magnetic Toner 10, evaluation was made in the same manner as in Example 1. Its physical properties are shown in Table 1, and the results of evaluation in Table 2.

Comparative Example 2

Magnetic Toner Particles B-9 with a weight-average particle diameter (D4) of 10.5 μm and an average circularity of 0.910 in 3 μm or larger particles were obtained in the same manner as in Example 5 except that the air flow on the coarse powder cut side of the air classifier was made lower by 20%.

Next, to Magnetic Toner Particles B-9, Magnetic Particles C-2 obtained in Example 2 were little by little so added and mixed that magnetic particles contained in 5 g of toner to be prepared came to 250 particles or thereabout, counting the particles by means of the measuring device having a mesh with an opening of 34 μm. To 100 parts by weight of the mixture obtained, 1.0 part by weight of the same hydrophobic fine silica powder as that used in Example 1 was externally added in the same manner as in Example 1, and these were introduced into Gyro Sifter to carry out sifting to obtain Magnetic Toner 11. As shown in Table 1, Magnetic Toner 11 had a weight-average particle diameter (D4) of 10.7 μm, a ratio thereof to number-average particle diameter (D1), D4/D1, of 1.85 and a true density d of 1.74 g/cm$^3$. On Magnetic Toner 11, evaluation was made in the same manner as in Example 1. Its physical properties are shown in Table 1, and the results of evaluation in Table 2.

Comparative Example 3

In Production of Magnetic Toner in Example 1, Crushed Product A-1 was obtained by the same procedure. Thereafter, this Crushed Product A-1 was finely pulverized by means of a jet mill grinding machine IDS 2 Type (manufactured by Nippon Pneumatic MFG Co., Ltd.). The finely pulverized product obtained by pulverization was further classified by means of an air classifier in the same manner as in Example 1, and fine powder and coarse powder which were obtained by classification were mixed in a weight ratio of 1:1 to obtain Magnetic Toner Particles B-10 with a weight-average particle diameter (D4) of 3.8 μm and an average circularity of 0.905 in 3 μm or larger particles.

To Magnetic Toner Particles B-10, Magnetic Particles C-1 obtained in Example 1 were little by little so added and mixed that magnetic particles contained in 5 g of toner to be prepared came to a little less than 10 particles, counting the particles by means of the measuring device having a mesh with an opening of 34 μm. To the mixture obtained, hydrophobic fine silica powder and strontium titanate were externally added in the same manner as in Example 1, and these were introduced into Gyro Sifter to carry out sifting to obtain Magnetic Toner 12. As shown in Table 1, Magnetic Toner 12 had a weight-average particle diameter (D4) of 3.8 μm, a ratio thereof to number-average particle diameter (D1), D4/D1, of 1.74 and a true density d of 1.77 g/cm$^3$. On Magnetic Toner 12, evaluation was attempted in the same manner as in Example 1. However, in a low-humidity environment, fog appeared so seriously that the evaluation was stopped. Its physical properties are shown in Table 1, and the results of evaluation only in a high-humidity environment, in Table 2.

Comparative Example 4

In order to examine influence of a case in which the magnetic particles were contained in excess, Magnetic Toner 13 was obtained in the same manner as in Production of Magnetic Toner in Example 8 except that, to Magnetic Toner Particles B-7, Magnetic Particles C-5 were little by little so added and mixed that magnetic particles contained in 5 g of toner to be prepared came to 300 particles or more, counting the particles by means of the measuring device having a mesh with an opening of 34 μm. As shown in Table 1, Magnetic Toner 13 had a weight-average particle diameter (D4) of 6.0 μm and a ratio thereof to number-average particle diameter (D1), D4/D1, of 1.88 and a true density d of 1.79 g/cm$^3$. On Magnetic Toner 13, evaluation was made in the same manner as in Example 1. Its physical properties are shown in Table 1, and the results of evaluation in Table 2.

Comparative Example 5

In Production of Magnetic Toner in Example 1, Crushed Product A-1 was obtained by the same procedure. Thereafter, this Crushed Product A-1 was finely pulverized by means of a jet mill grinding machine IDS 2 Type (manufactured by Nippon Pneumatic MFG Co., Ltd.). The finely pulverized product obtained by pulverization was further classified in the same manner as in Example 1 except that the air flow on the fine powder side of the air classifier and the air flow on the coarse powder cut side thereof were both made higher by 20%. The median powder obtained by this classification was further classified by means of an air classifier in the same manner as in Example 1. The classified product obtained was sifted using High Bolter NR-300 to obtain Magnetic Toner Particles B-11 with an average circularity of 0.905 in 3 μm or larger particles. Here, a mesh with an opening of 35 μm was used in the sifter. To 100 parts by weight of the mixture obtained, 1.0 part by weight of the same hydrophobic fine silica powder as that used in Example 1 was externally added by means of a Henschel mixer, and these were introduced into Gyro Sifter to carry out sifting to obtain-Magnetic Toner 14. Magnetic Toner 14 had a weight-average particle diameter (D4) of 6.4 μm. It had a true density d of 1.73 g/cm$^3$. This Magnetic Toner 14 also had a D4/D1 value of 1.12, having a sharp particle size distribution. However, as a result of calculation of yield, this value was 45%, which was undesirable in view of production. Its physical properties are shown in Table 1, and the results of evaluation in Table 2.

TABLE 1

| | | Particles having remained on: | | | | Average circularity Particles having: | | | | | | |
|---|---|---|---|---|---|---|---|---|---|---|---|---|
| | | mesh with 34 μm opening | | mesh with 100 μm opening | | passed mesh with | remained on mesh with | | | | | |
| Magnetic Toner: | True density d (g/cm$^3$) | per 5 g | per unit volume | per 100 g | per unit volume | 34 μm opening | 34 μm opening | D4 (μm) | D4/D1 | DSC peak of wax (° C.) | Shape of magnetic material | Inorganic fine powder |
| 1 | 1.78 | 70 | 24.9 | 3 | 0.0534 | 0.925 | 0.904 | 7.1 | 1.41 | 98 | oct. | yes |
| 2 | 1.76 | 190 | 66.9 | 17 | 0.299 | 0.917 | 0.907 | 8.5 | 1.72 | 98 | oct. | yes |
| 3 | 1.78 | 39 | 13.9 | 1 | 0.178 | 0.930 | 0.904 | 5.4 | 1.31 | 98 | oct. | yes |
| 4 | 1.74 | 13 | 4.52 | 0 | 0 | 0.930 | 0.904 | 5.3 | 1.30 | 98 | oct. | — |
| 5 | 1.77 | 270 | 95.6 | 22 | 0.389 | 0.909 | 0.907 | 9.4 | 1.92 | 98 | oct. | yes |
| 6 | 1.72 | 18 | 6.20 | 2 | 0.0344 | 0.927 | 0.899 | 6.2 | 1.90 | 62 | sph. | — |
| 7 | 1.73 | 45 | 15.6 | 4 | 0.0692 | 0.912 | 0.908 | 7.7 | 1.43 | 145 | oct. | — |

TABLE 1-continued

| Magnetic Toner: | True density d (g/cm³) | Particles having remained on: mesh with 34 μm opening per 5 g | per unit volume | mesh with 100 μm opening per 100 g | per unit volume | Average circularity Particles having: passed mesh with 34 μm opening | remained on mesh with 34 μm opening | D4 (μm) | D4/D1 | DSC peak of wax (° C.) | Shape of magnetic material | Inorganic fine powder |
|---|---|---|---|---|---|---|---|---|---|---|---|---|
| 8 | 1.80 | 15 | 5.40 | 1 | 0.0180 | 0.903 | 0.909 | 5.6 | 1.25 | — | oct. | yes |
| 9 | 1.78 | 42 | 15.0 | 3 | 0.0534 | 0.925 | 0.909 | 7.2 | 1.78 | 98 | oct. | yes |
| 10 | 1.79 | 14 | 5.01 | 2 | 0.0358 | 0.899 | 0.909 | 9.8 | 2.20 | — | oct. | yes |
| 11 | 1.74 | 250 | 87.0 | 21 | 0.365 | 0.910 | 0.907 | 10.7 | 1.85 | 98 | oct. | — |
| 12 | 1.77 | 8 | 2.83 | 3 | 0.0531 | 0.905 | 0.904 | 3.8 | 1.74 | 98 | oct. | yes |
| 13 | 1.79 | 320 | 115 | 26 | 0.465 | 0.903 | 0.909 | 6.0 | 1.88 | — | oct. | yes |
| 14 | 1.73 | 2 | 0.69 | 0 | 0 | 0.905 | — | 6.4 | 1.12 | 98 | oct. | — |

oct.: octahedral;
sph.: spherical

TABLE 2

| | Toner adhesion | Faulty cleaning, photosensitive member scratching | Image density | Fog |
|---|---|---|---|---|
| Example: | | | | |
| 1 | A | A | A | A |
| 2 | A | A | A | A |
| 3 | A | A | A | A |
| 4 | A | B | A | A |
| 5 | B | C | A | B |
| 6 | C | C | A | A |
| 7 | A | B | A | A |
| 8 | C | C | A | A |
| 9 | B | C | A | A |
| Comparative Example: | | | | |
| 1 | D | C | C | C |
| 2 | C | D | C | B |
| 3 | — | — | B | C |
| 4 | C | D | C | C |
| 5 | C | D | A | A |

What is claimed is:

1. An image forming apparatus comprising:

an amorphous silicon photosensitive member;

two or more developing means provided in respect to the amorphous silicon photosensitive member; one of the developing means being a magnetic-toner developing means having a magnetic toner, and the remaining developing means being a color developer developing means having a developer containing a non-magnetic color toner; and a cleaning means provided in contact with the surface of the amorphous silicon photosensitive member to clean the surface of the photosensitive member;

said magnetic toner having a weight-average particle diameter D4 of from 4.0 μm to 10.0 μm and a ratio thereof to number-average particle diameter D1, D4/D1, of from 1.0 to 2.0; and where the true density of said magnetic toner is represented by d (g/cm³) and the number of magnetic particles not passing through a mesh with an opening of 34 μm which are contained in m (g) of said magnetic toner is represented by n, the number N (=n/(m/d)) of magnetic particles not passing through a mesh with an opening of 34 μm which are contained in the unit volume of said magnetic toner satisfying the following expression:

$$3.5<N<105.$$

2. The image forming apparatus according to claim 1, wherein the number N of magnetic particles not passing through a mesh with an opening of 34 μm which are contained in the unit volume of said magnetic toner satisfies the following expression:

$$10.5<N<71.0.$$

3. The image forming apparatus according to claim 1, wherein, where the true density of said magnetic toner is represented by d (g/cm³) and the number of magnetic particles not passing through a mesh with an opening of 100 μm which are contained in m (g) of said magnetic toner is represented by f, the number F (=f/(m/d)) of magnetic particles not passing through a mesh with an opening of 100 μm which are contained in the unit volume of said magnetic toner satisfies the following expression:

$$F<0.36.$$

4. The image forming apparatus according to claim 1, wherein said magnetic toner contains a release agent having an endothermic peak temperature within the range of from 65° C. to 130° C. at the time of heating as measured with a differential scanning calorimeter DSC.

5. The image forming apparatus according to claim 1, wherein said magnetic particles not passing through a mesh with an opening of 34 μm have an average circularity smaller than the average circularity of magnetic particles passing through a mesh with an opening of 34 μm.

6. The image forming apparatus according to claim 1, wherein said magnetic particles passing through a mesh with an opening of 34 μm have an average circularity smaller than the average circularity of said non-magnetic color toner.

7. The image forming apparatus according to claim 1, wherein said magnetic toner further contains at least an inorganic fine powder represented by the following formula:

$$[M_1]_a[M_2]_bO_c$$

wherein $M_1$ represents a metallic element selected from the group consisting of Sr, Mg, Zn, Co, Mn, Ca, Ba and Ce; $M_2$ represents any of metallic elements Ti and Si; a represents an integer of 1 to 9; b represents an integer of 1 to 9; and c represents an integer of 3 to 9.

8. The image forming apparatus according to claim 1, wherein a magnetic material contained in said magnetic toner comprises iron oxide particles having an octahedral shape.

* * * * *

UNITED STATES PATENT AND TRADEMARK OFFICE

CERTIFICATE OF CORRECTION

PATENT NO. : 7,123,862 B2 
APPLICATION NO. : 10/832445
DATED : October 17, 2006
INVENTOR(S) : Yusuke Hasegawa et al.

It is certified that error appears in the above-identified patent and that said Letters Patent is hereby corrected as shown below:

ON THE TITLE PAGE [56] REFERENCES CITED:

Foreign Patent Documents, " 00-10334 should read --2000-10334
001-249488 2001-249488
002-49172 2002-49172
002-91053 2002-91053
002-162772" 2002-162772--.

COLUMN 13:

Lines 49-54, " 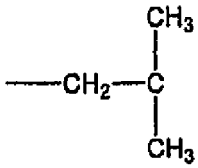 " should read -- 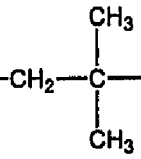 --.

COLUMN 36:

Line 41, "obtain-Magnetic" should read --obtain Magnetic--.

Signed and Sealed this

Twenty-sixth Day of June, 2007

JON W. DUDAS
*Director of the United States Patent and Trademark Office*